US011821671B2

(12) United States Patent
Heo et al.

(10) Patent No.: US 11,821,671 B2
(45) Date of Patent: Nov. 21, 2023

(54) REFRIGERATOR WITH SHELF AIR REGULATOR

(71) Applicant: SAMSUNG ELECTRONICS CO., LTD., Suwon-si (KR)

(72) Inventors: Eun Heo, Suwon-si (KR); Kyoungsun Park, Suwon-si (KR); Huido Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 133 days.

(21) Appl. No.: 17/307,201

(22) Filed: May 4, 2021

(65) Prior Publication Data

US 2021/0348826 A1 Nov. 11, 2021

(30) Foreign Application Priority Data

May 7, 2020 (KR) ..... 10-2020-0054511

(51) Int. Cl.
*F25D 17/04* (2006.01)
*F25D 25/02* (2006.01)

(52) U.S. Cl.
CPC ..... *F25D 17/045* (2013.01); *F25D 25/02* (2013.01); *F25D 2317/0672* (2013.01)

(58) Field of Classification Search
CPC ..... F25D 25/02; F25D 25/028; F25D 17/045; F25D 25/025; F25D 2317/0672
See application file for complete search history.

(56) References Cited

U.S. PATENT DOCUMENTS

| | | | | |
|---|---|---|---|---|
| 4,850,206 | A | 7/1989 | Larsen | |
| 10,677,522 | B1 * | 6/2020 | Stauffer | F25D 17/045 |
| 2006/0199495 | A1 | 9/2006 | Yamaguchi | |
| 2006/0248916 | A1 * | 11/2006 | Kim | F25D 25/025 62/187 |
| 2009/0199587 | A1 * | 8/2009 | Matthews | F25D 25/025 62/448 |
| 2017/0234605 | A1 * | 8/2017 | Pfister | A47B 57/16 312/408 |
| 2018/0274841 | A1 * | 9/2018 | Cizik | F25D 17/045 |

(Continued)

FOREIGN PATENT DOCUMENTS

| | | |
|---|---|---|
| CN | 104006622 A | 8/2014 |
| KR | 1997-0028300 | 6/1997 |
| KR | 10-0162429 | 1/1999 |

(Continued)

OTHER PUBLICATIONS

International Search Report dated Aug. 13, 2021 in International Application No. PCT/KR2021/005300 (3 pages).

(Continued)

*Primary Examiner* — Cassey D Bauer
(74) *Attorney, Agent, or Firm* — STAAS & HALSEY LLP

(57) ABSTRACT

A refrigerator includes a storage compartment to which cold air is supplied through a cold air outlet, and a shelf mounted to the storage compartment. The shelf includes a shelf frame provided to form a rim of the shelf, and a cold air regulator manipulated from one side of the shelf frame so as to adjust an amount of cold air discharged from the cold air outlet to the storage compartment. The cold air regulator includes a connecting member configured to be slidable along the rim of the shelf.

21 Claims, 21 Drawing Sheets

(56) References Cited

U.S. PATENT DOCUMENTS

2019/0017741 A1* 1/2019 Staud ..... F25D 25/024

FOREIGN PATENT DOCUMENTS

| | | |
|---|---|---|
| KR | 2000-0010969 | 6/2000 |
| KR | 10-0524785 | 10/2005 |
| KR | 10-0705160 | 4/2007 |
| KR | 20-2009-0006505 | 7/2009 |
| KR | 20-2009-0006506 | 7/2009 |
| KR | 10-2009-0133010 | 12/2009 |
| KR | 10-2011-0036446 | 4/2011 |
| KR | 10-1060398 | 8/2011 |
| KR | 10-2018-0080053 | 7/2018 |
| KR | 10-1979396 | 5/2019 |

OTHER PUBLICATIONS

Extended European Search Report dated Nov. 22, 2022 for European Application No. 21800185.7.

* cited by examiner

REFRIGERATOR WITH SHELF AIR REGULATOR

CROSS-REFERENCE TO RELATED APPLICATION(S)

This application is based on and claims priority under 35 U.S.C. § 119 to Korean Patent Application No. 10-2020-0054511, filed on May 7, 2020, in the Korean Intellectual Property Office, the disclosure of which is incorporated by reference herein in its entirety.

BACKGROUND

1. Field

The disclosure relates to a refrigerator, and more particularly, to a refrigerator including a shelf including an improved structure.

2. Description of Related Art

A refrigerator is a home appliance that stores food fresh by including a storage compartment storing food and a cold air supply device supplying cold air to the storage compartment.

A temperature of the storage compartment is maintained at a temperature within a certain range required to keep food fresh. The storage compartment of the refrigerator includes an open front surface and the open front surface may be usually closed by a door so as to maintain the temperature of the storage compartment.

A shelf dividing the storage compartment into a plurality of storage spaces, and a storage box storing food in a space thereof are provided inside the storage compartment. The storage box has a shape, in which an upper portion is open, and is generally provided to be withdrawable under the shelf.

In this case, by controlling the amount of cold air discharged to the storage compartment under the shelf partitioned by the shelf or the storage box, a temperature of the corresponding area may be adjusted according to the type of food to be stored. The temperature control may be obtained by opening and closing a cold air outlet through which cold air is discharged. In addition, the cold air outlet may be opened or closed by an operating lever provided at a front end of the shelf, or may be directly opened and closed through an opening and closing member separately provided inside the storage compartment.

However, because a member, which is connected to the operating lever and provided to open and close the cold air outlet, is formed across the shelf, the visibility of a lower portion of the shelf may be reduced and it may cause a negative effect on the interior of the storage compartment. In addition, it may be difficult for a user to access the opening and closing member inside the storage compartment, which may cause inconvenience.

SUMMARY

Therefore, it is an aspect of the disclosure to provide a refrigerator capable of adjusting an amount of discharged cold air on a front side of a shelf.

It is another aspect of the disclosure to provide a refrigerator including a shelf having an improved structure to ensure the visibility of a lower portion of the shelf.

Additional aspects of the disclosure will be set forth in part in the description which follows and, in part, will be obvious from the description, or may be learned by practice of the disclosure.

In accordance with an aspect of the disclosure, a refrigerator includes a storage compartment to which cold air is supplied through a cold air outlet, and a shelf mounted to the storage compartment. The shelf includes a shelf frame provided to form a rim of the shelf, and a cold air regulator manipulated from one side of the shelf frame so as to adjust an amount of cold air discharged from the cold air outlet to the storage compartment. The cold air regulator includes a connecting member configured to be slidable along the rim of the shelf.

The cold air regulator may further include a knob provided to protrude to an outside of the shelf frame to be manipulated, and an opening and closing member configured to open and dose the cold air outlet. The connecting member may connect the knob to the opening and closing member.

The knob may be mounted to be movable with respect to the shelf frame, and the connecting member and the opening and closing member may be moved by a moving distance of the knob.

The shelf frame may include a plurality of guide ribs formed on the rim of the shelf frame to guide a movement of the connecting member.

The connecting member may be movable in close contact between the plurality of guide ribs and a side wall of the shelf frame.

The plurality of guide ribs may be formed in a curved shape and provided to be in contact with the connecting member.

The plurality of guide ribs may extend from one surface of the shelf frame toward a direction perpendicular to a moving direction of the connecting member.

The opening and closing member may include a coupling portion provided to extend toward the connecting member so as to be fitted to the connecting member. The connecting member may include a coupling portion insertion hole into which the coupling portion is inserted.

The shelf frame may include an accommodation portion formed on a side of the cold air outlet and provided to allow the opening and closing member to be movably accommodated therein The opening and closing member may include a body, and a cold air inlet formed in the body to communicate with the cold air outlet so as to pass cold air.

The accommodation portion may include an opening respectively formed in an inner wall and an outer wall of the shelf frame so as to correspond to the cold air inlet of the opening and closing member. Cold air discharged from the cold air outlet may be supplied to the storage compartment through the opening of the shelf frame and the cold air inlet of the opening and dosing member.

The refrigerator may further include a packing member mounted on the shelf frame to block between the opening formed in the outer wall of the shelf frame and the cold air outlet.

The connecting member may be formed of a poly oxy methylene (POM).

The shelf may further include a glass coupled to the shelf frame to support an object. The cold air regulator may be mounted on an outside of a rim of the glass to be movable with respect to the shelf frame.

The shelf frame may include a first frame provided in a lower portion of the shelf, and a second frame coupled to an upper portion of the first frame. The cold air regulator may be accommodated in a space between the first frame and the second frame, and mounted to be movable with respect to the shelf frame.

In accordance with another aspect of the disclosure, a refrigerator includes a storage compartment to which cold air is supplied through a cold air outlet, and a shelf mounted to the storage compartment. The shelf includes a shelf frame provided to form a rim of the shelf and including an opening provided to communicate with a cold air outlet formed in the main body, and a cold air regulator including a knob movably mounted to the shelf, the cold air regulator configured to open and close the cold air outlet by sliding with respect to the shelf frame according to a movement of the knob.

The cold air regulator may include an opening and closing member provided on a side of the opening of the shelf frame to open and dose the cold air outlet, and a connecting member provided to connect the knob to the opening and closing member. The connecting member and the opening and closing member may be moved by a moving distance of the knob.

The shelf frame may include a plurality of guide ribs provided to extend from one side wall of the shelf frame to allow the connecting member to be moved in dose contact with the side wall of the shelf frame.

In accordance with another aspect of the disclosure, a refrigerator includes a storage compartment to which cold air is supplied through a cold air outlet, a shelf frame mounted to the storage compartment to form a rim of the shelf, a glass coupled to the shelf frame, and a cold air regulator mounted to be slidable inside the shelf frame to adjust an amount of cold air discharged from the cold air outlet, the cold air regulator provided outside a rim of the glass.

The shelf frame may include a plurality of guide ribs formed in a curved shape to guide a movement of the cold air regulator.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
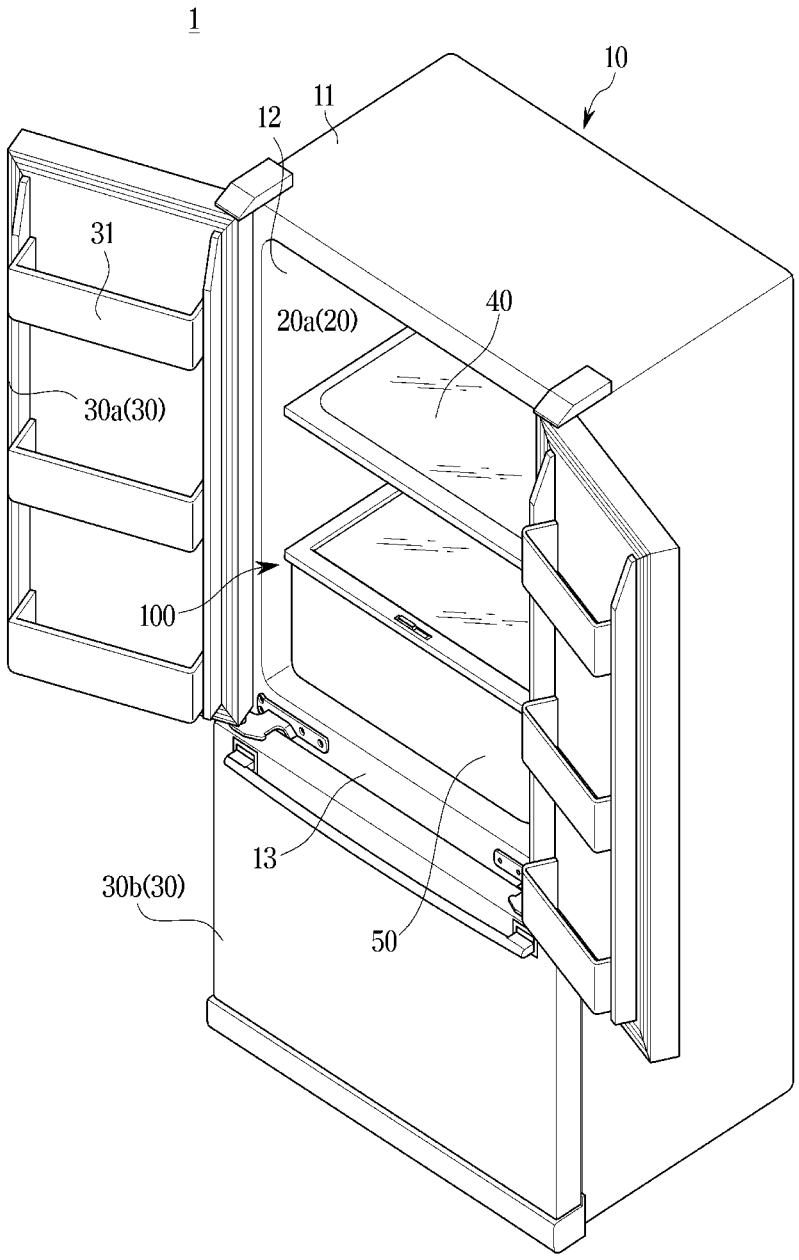
FIG. 1 is a perspective view illustrating a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "upper portion", "lower portion", "upper end", "lower end" and the like may be defined by the drawings, but the shape and the location of the component is not limited by the term.

The disclosure will be described more fully hereinafter with reference to the accompanying drawings.

FIG. 1 is a perspective view illustrating a refrigerator according to an embodiment of the disclosure.

Referring to FIG. 1, a refrigerator 1 may include a main body 10 and a storage compartment 20 provided in the main body 10 and including an open front surface to allow an object to be put into and taken out of the storage compartment.

The refrigerator 1 may include a door 30 rotatably coupled to the main body 10 to open and close the open front surface of the storage compartment 20 and a cold air supply device configure to supply cold air to the storage compartment 20. In this case, cold air is supplied to the storage compartment 20 through a cold air outlet 60 (shown in FIG. 2) formed in the main body 10.

The main body 10 may include an outer case 11 and an inner case 12. The outer case 11 may form an appearance of the main body 10. The outer case 11 may be formed of a metal material having excellent durability and aesthetics.

The inner case 12 may be located inside the outer case 11. The inner case 12 may form an appearance of the storage compartment 20. The inner case 12 may be formed of a plastic material and may be integrally injection-molded.

The storage compartment 20 may be divided into a plurality of storage compartments 20 by a partition 13. The storage compartment 20 may include an upper storage compartment 20 and a lower storage compartment (not shown).

The storage compartment 20 may include a refrigerating compartment and a freezing compartment. Depending on the type of refrigerator 1, the upper storage compartment 20 may be provided as the refrigerating compartment, and the lower storage compartment may be provided as the freezing compartment, or alternatively, the upper storage compartment 20 may be provided as the freezing compartment, and the lower storage compartment may be provided as the refrigerating compartment.

The refrigerator 1 shown in FIG. 1 is a refrigerator in which the upper storage compartment 20 is provided as a refrigerating compartment and a lower storage compartment is provided as a freezing compartment.

However, the shape of the refrigerator 1 of the disclosure is not limited thereto, and may be applied to other types of refrigerators as long as a storage box 50 is mounted to the storage compartment such as a refrigerating compartment or a freezing compartment.

Other types of refrigerators include a side-by-side (SBS) type refrigerator in which a freezing compartment and a refrigerating compartment are disposed left and right, or a top mounted freezer (TMF) type refrigerator in which a freezing compartment is disposed above a refrigerating compartment.

The freezing compartment may be maintained at about −20 degrees Celsius, and the refrigerating compartment may be maintained at about 3 degrees Celsius. The freezing compartment and the refrigerating compartment may be insulated by the partition 13.

The storage compartment 20 may be opened and closed by the door 30. The upper storage compartment 20 may be opened and closed by a pair of upper doors 30*a* rotatably coupled to the main body 10. The lower storage compartment (not shown) may be opened and closed by a drawer-type lower door 30*b* slidably coupled to the main body 10. However, the disclosure is not limited thereto, and the door 30 may be provided in various ways as long as it is capable of opening and closing the storage compartment 20.

A plurality of door guards 31 in which an object is stored may be provided on a rear surface of an upper door 30*a*. The door guard 31 may be provided to accommodate a small object.

The storage compartment 20 may be provided with a shelf 40 provided to support objects stored in the storage compartment 20. The shelf 40 may be provided in plural. The shelf 40 may be installed anywhere in the refrigerating compartment or the freezing compartment.

Because the shelves 40 and 100, which are disposed to be spaced apart from each other in the vertical direction, divide an inside of the storage compartment 20 into multiple stages, it is possible to increase the utilization efficiency of the storage space and easily store objects to be stored.

In addition, the shelf 100 may include a cold air regulator 200 (refer to FIG. 4) configured to adjust a temperature of the partitioned storage compartment 20 by regulating an opening degree of the cold air outlet 60 through which cold air is supplied to the inside of the storage compartment 20.

The shelf 100 may be disposed in the storage compartment 20 by being mounted to a supporter (not shown) formed in the inner case 12 of the main body 10. Further, because the inner case 12 is recessed and the shelf 100 is fitted to the recessed portion of the inner case 12, it is possible to prevent the shelf 100 from being moved or separated. Details of the shelf 100 will be described later.

In addition, in the storage compartment 20, the drawer type storage box 50 in which vegetables or fruits are stored may be installed. The storage box 50 may be provided to store objects in an enclosed inner space. The storage box 50 may be disposed under the shelf 100 and coupled to be withdrawable. The storage box 50 may include an approximately open top surface.

When the storage box 50 is coupled to the lower portion of the shelf 100 including the cold air regulator 200, an internal temperature of the storage box 50 may be adjusted by the cold air regulator 200 of the shelf 100. Accordingly, a user can adjust the temperature of the storage box 50 according to the type of objects stored in the storage box 50. FIG. 1 illustrates that the storage box 50 is coupled to the lower portion of the shelf 100 including the cold air regulator 200, but is not limited thereto. Therefore, even when the storage box 50 is not coupled thereto, it is possible to adjust the temperature of the storage compartment 20 partitioned by the shelf 100.

In addition, although not shown in the drawing, the two storage boxes 50 may be provided and coupled to the lower portion of the shelf 100. In this case, the two cold air outlets 60 of the main body 10 may also be provided so as to supply cold air to each storage box 50. In addition, two cold air regulators 200 configured to adjust the opening degree of each cold air outlet 60 may be provided to allow a user to adjust the temperature of the two storage boxes 50 independently of each other. In this case, each of the two cold air regulators 200 may be provided to be slidable along an edge of one side of the shelf and an edge of the other side of the shelf, respectively.

Figure 2:
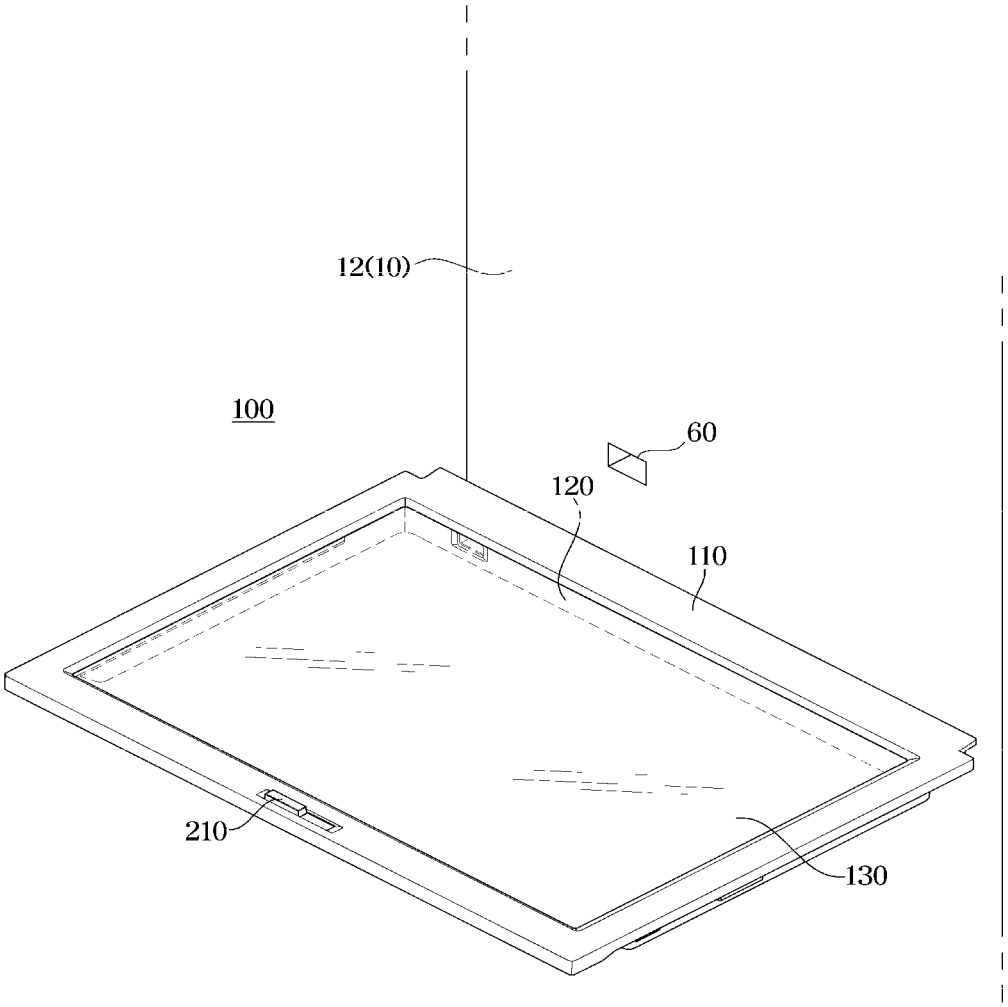
FIG. 2 is a front perspective view illustrating a shelf of the refrigerator shown in FIG. 1.
Figure 3:
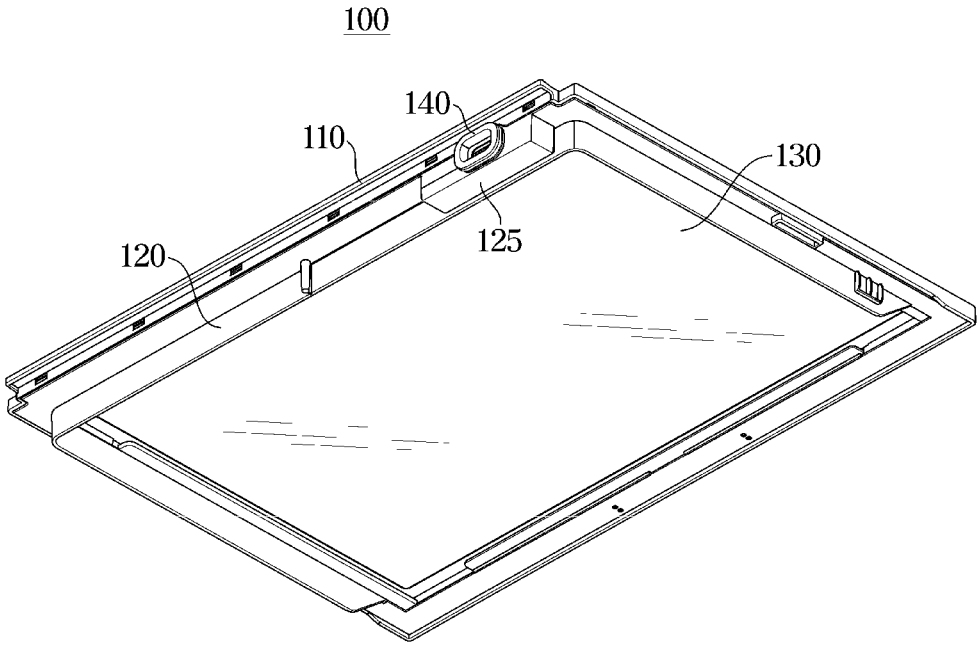
FIG. 3 is a rear perspective view illustrating the shelf of the refrigerator shown in FIG. 1.
Figure 4:
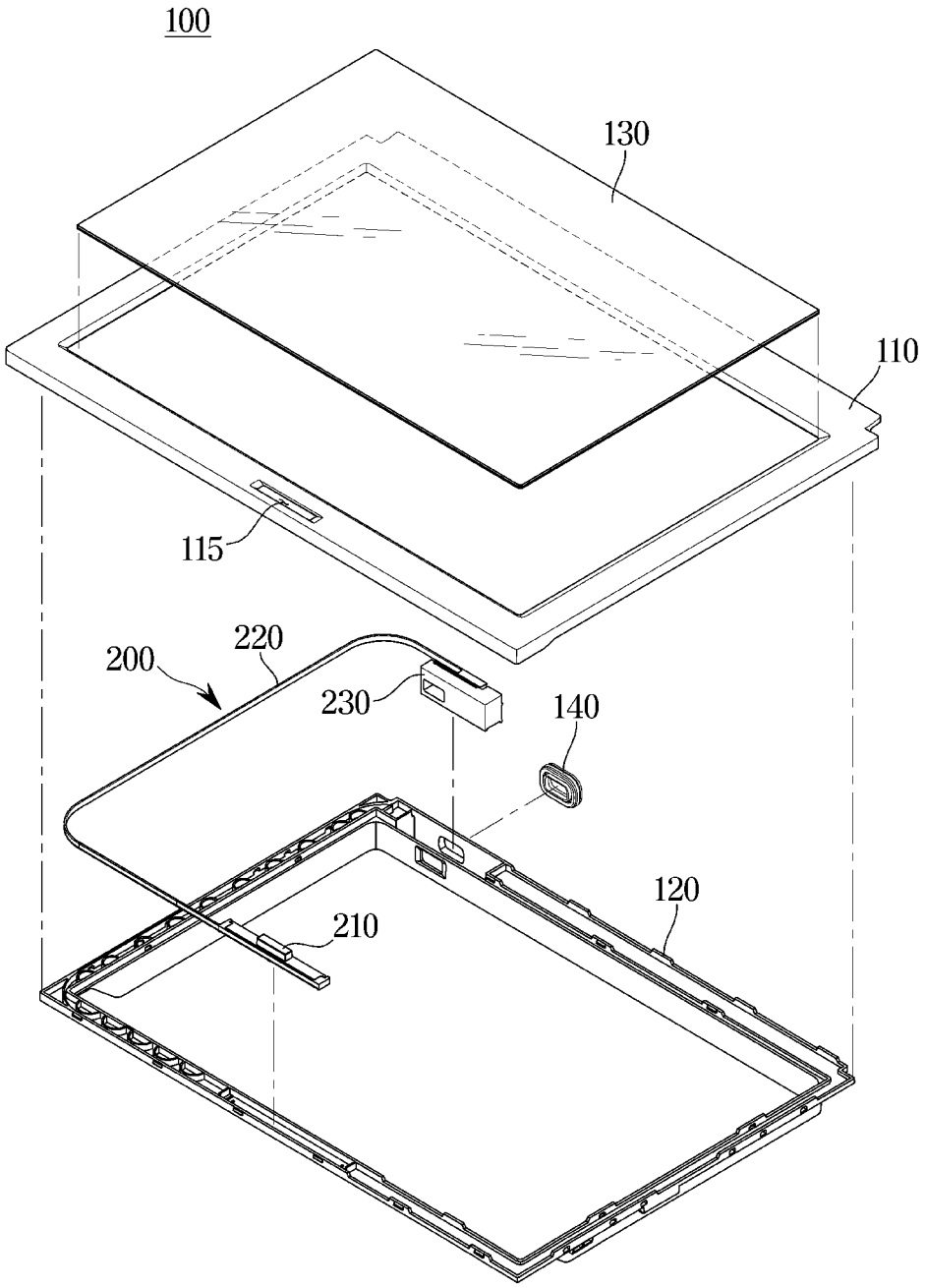
FIG. 4 is an exploded perspective view of the shelf of the refrigerator according to an embodiment of the disclosure.

FIG. 2 is a front perspective view illustrating a shelf of the refrigerator shown in FIG. 1. FIG. 3 is a rear perspective view illustrating the shelf of the refrigerator shown in FIG. 1. FIG. 4 is an exploded perspective view of the shelf of the refrigerator according to an embodiment of the disclosure.

Referring to FIGS. 2 to 4, the shelf 100 may include shelf frames 110 and 120, a glass 130 coupled to the shelf frames 110 and 120, and the cold air regulator 200 accommodated to be slidable in the shelf frames 110 and 120. Further, the shelf 100 may include a packing member 140 provided to block between the shelf frames 110 and 120 and the cold air outlet 60.

The shelf frames 110 and 120 may include a first frame 120 provided in a lower portion of the shelf frame and a second frame 110 coupled to an upper portion of the first frame 120. The first frame 120 and the second frame 110 may be vertically coupled so as to have a substantially rectangular ring shape. Accordingly, the first frame 120 and the second frame 110 may form a rim of the shelf 100.

The cold air regulator 200 may be accommodated in the first frame 120. The cold air regulator 200 may be provided to be movable with respect to the first frame 120.

The second frame 110 may cover the upper portion of the cold air regulator 200, which is moved in the first frame 120, and thus even when the cold air regulator 200 is operated, the cold air regulator 200 may not be separated from the first frame 120.

Particularly, the cold air regulator 200 may be accommodated in a space between the first frame 120 and the second frame 110 and configured to be movable therebetween. That is, the cold air regulator 200 may be configured to be movable along the rim of the shelf 100. A detailed configuration of the cold air regulator 200 will be described later.

The second frame 110 may include a knob through hole 115 provided to be cut out to allow a user to manipulate the cold air regulator 200 from the outside of the 100. Particularly, a portion of a knob 210 of the cold air regulator 200 may protrude to the outside of the shelf 100 by passing through the knob through hole 115. The knob through hole 115 is formed approximately in the front center of the upper surface of the second frame 110. Accordingly, a user can manipulate the cold air regulator 200 from the front side of the storage compartment 20. However, the disclosure is not limited thereto, and the knob through hole 115 may be formed on any position of the upper surface of the second frame 110 as long as a user can access thereto.

The knob 210 may be configured to be movable within the knob through hole 115. Because the knob 210 is movable with respect to the second frame 110 by a length of the knob through hole 115 that is cut, a moving distance of the knob 210 may be limited within a length determined by the knob through hole 115.

In addition, because the movement of the knob 210 is transmitted to an opening and closing member 230 by a connecting member 220, a moving distance of the opening and closing member 230 may also be limited within a certain range.

The glass 130 may be coupled to the shelf frames 110 and 120 to form a central portion of the shelf 100. Accordingly, objects in the storage compartment 20 may be supported by the glass 130. Particularly, an object may be accommodated and supported on the upper surface of the glass 130. In addition, the glass 130 is formed of a transparent glass material and provided to allow a user to check out a state of the lower portion of the shelf 100.

The packing member 140 may be mounted on a rear portion of the shelf 100. Particularly, the packing member 140 may be mounted on an opening 159 (refer to FIG. 9), which is formed on a rear portion of the first frame 120, to block between the cold air outlet 60 and the first frame 120. The loss of cold air may be minimized by the packing member 140.

Figure 5:
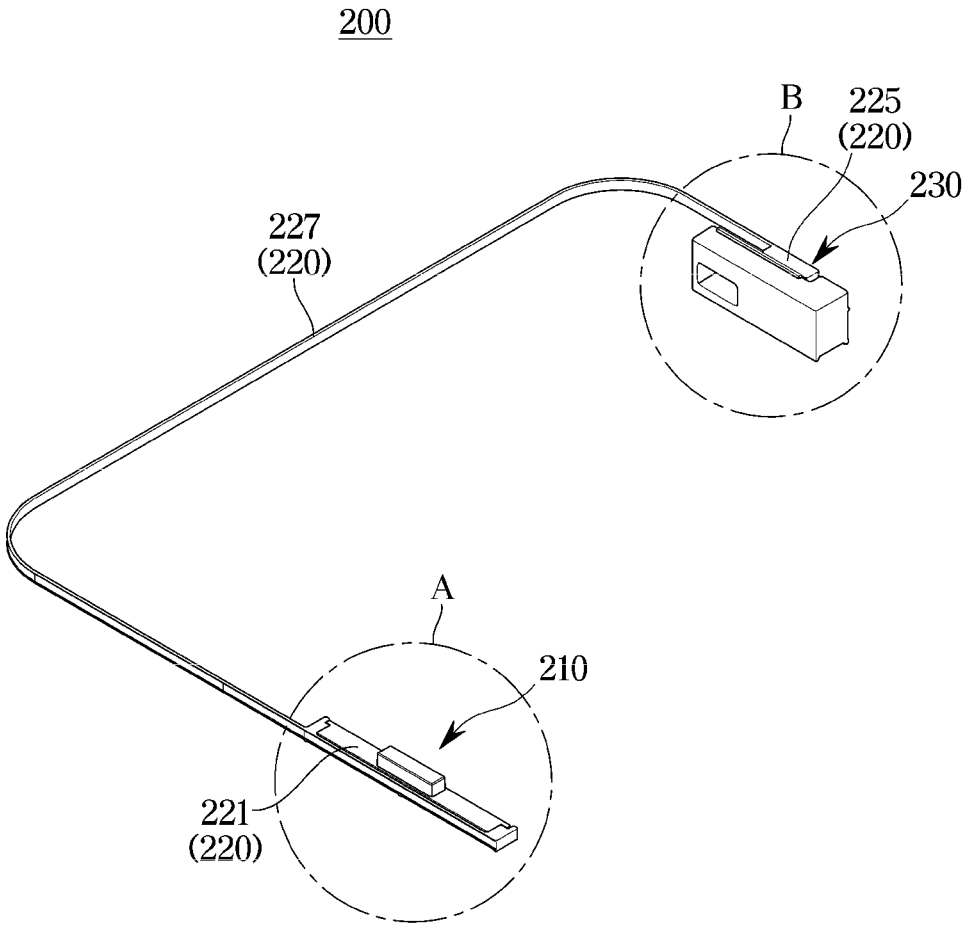
FIG. 5 is a front perspective view illustrating a cold air regulator of the refrigerator according to an embodiment of the disclosure.
Figure 6:
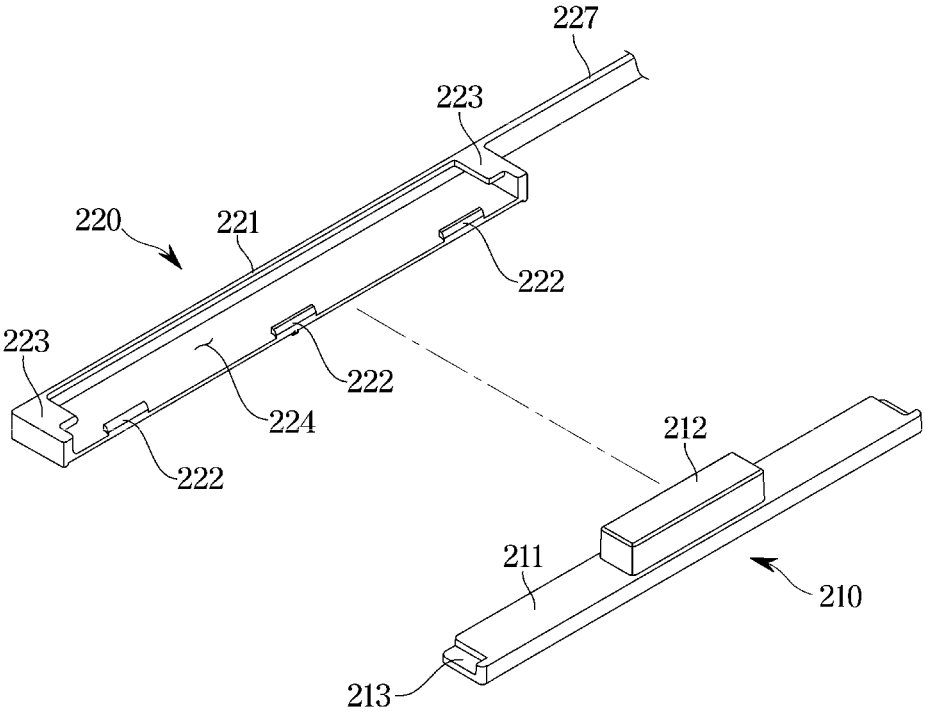
FIG. 6 is a rear perspective view illustrating an enlarged portion A of FIG. 5.
Figure 7:
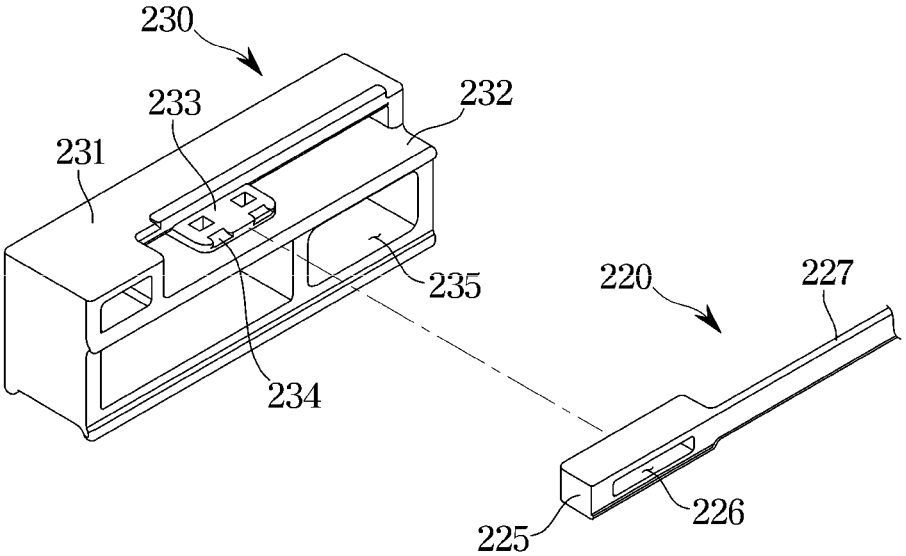
FIG. 7 is a rear perspective view illustrating an enlarged portion B of FIG. 5.

FIG. 5 is a front perspective view illustrating a cold air regulator of the refrigerator according to an embodiment of the disclosure. FIG. 6 is a rear perspective view illustrating an enlarged portion A of FIG. 5. FIG. 7 is a rear perspective view illustrating an enlarged portion B of FIG. 5.

Referring to FIG. 5, the cold air regulator 200 may include the knob 210, the connecting member 220 and the opening and closing member 230 configured to open and close the cold air outlet 60.

The knob 210 may be provided in the front portion of the shelf 100 to be gripped by a user. As shown in FIG. 2, the knob 210 may be exposed to a user through the knob through hole 115 of the shelf frames 110 and 120. In addition, the opening and closing member 230 may be provided at the rear portion of the shelf 100 and provided to allow a user to directly open and close the cold air outlet 60.

The connecting member 220 may be provided in a shape having a length. The connecting member 220 may include a first connecting portion 221 formed at one end in a longitudinal direction and coupled to the knob 210, a second connecting portion 225 formed at the other end and coupled to the opening and closing member 230, and a third connecting portion 227 provided between the first connecting portion 221 and the second connecting portion 225.

As illustrated in FIG. 5, the connecting member 220 may be provided in an approximately "⊏" shape and may be mounted to be movable inside the shelf frames 110 and 120. The cold air regulator 200 shown in FIG. 5 is provided in '⊏' shape on the left side of the shelf frames 110 and 120 when viewed from the front, but is not limited thereto. Therefore, the cold air regulator 200 may be provided in a reversed '⊏' shape on the right side of the shelf frames 110 and 120 when viewed from the front. In this case, a plurality of guide ribs 121 to be described later may be formed on the right side of the first frame 120.

However, when the cold air outlet 60 is formed on the lateral side of the main body 10, the opening and closing member 230 configured to open and close the cold air outlet 60 may also be provided on the lateral side of the shelf 100. In addition, the opening and closing member 230 may be provided at the rear portion of the shelf 100 and the knob 210 may be provided on the lateral side of the shelf 100 to be manipulated. In this case, the knob through hole 115 of the shelf frames 110 and 120 may be provided on a lateral side of the upper surface of the shelf frames 110 and 120. Accordingly, the connecting member 220 may be formed in '∟' shape to have a shorter length.

Therefore, as long as the opening and closing member 230 is formed in accordance with the position of the cold air outlet 60 and the knob 210 is provided to be gripped by a user, the position of the opening and closing member 230 and the knob 210 and the shape of the connecting member 220 may not be limited to the position or shape shown in FIGS. 4 and 5.

Referring to FIG. 6, the knob 210 may include a knob body 211 mounted on the connecting member 220, a grip portion 212 protruding from the knob body 211, and a stepped portion 213 formed on both ends of the knob body 211.

The connecting member 220 may include the above-described first connecting portion 221 at one end in the longitudinal direction. The first connecting portion 221 may be provided in a substantially cut-out box shape by being connected to the third connecting portion 227. A knob accommodation space 224 may be formed inside the first connecting portion 221 to accommodate the knob 210.

The knob body 211 may be mounted on the inside of the connecting member 220 to transmit the movement of the knob 210 to the connecting member 220. The grip portion 212 may be provided to extend upward from the upper surface of the knob body 211 so as to be gripped by a user.

The first connecting portion 221 of the connecting member 220 may include a support portion 223 provided in a shape corresponding to the stepped portion 213 of the knob 210. The support portion 223 may extend from both ends of the first connecting portion 221 toward the knob 210 so as to be parallel to the upper surface of the knob body 211.

In addition, the first connecting portion 221 of the connecting member 220 may include at least one locking portion 222 formed on a side into which the knob 210 is inserted. At least one locking portion 222 may be formed to extend upward from a bottom surface of the first connecting portion 221. According to the embodiment, it is illustrated that three locking portions 222 are provided, but the number of the locking portions 222 is not limited thereto.

Therefore, because the knob 210 is inserted into the knob accommodation space 224 formed in the connecting member 220, the upward movement of the knob 210 may be limited by the support portion 223 and the rearward movement of the knob 210 may be limited by the at least one locking portion 222 of the connecting portion 220. That is, by preventing the knob 210 from being separated from the connecting member 220, the knob 210 and the connecting member 220 may be coupled to each other.

In addition, because the support portion 223 of the connecting member 220 is provided in a shape corresponding to the stepped portion 213 of the knob 210, the upper surface of the support portion 223 of the connecting member 220 and the upper surface of the knob body 211 may be provided at the same height.

Referring to FIG. 7, the opening and closing member 230 may include a body 231 and a seating portion 232 recessed into the body 231 to allow the connecting member 220 to be seated on the opening and closing member 230.

The connecting member 220 may include the above-mentioned second connecting portion 225 at the other end in the longitudinal direction. The second connecting portion 225 may be connected to the third connecting portion 227 and provided in an approximately hollow ring shape. The second connecting portion 225 may be provided with a coupling portion insertion hole 226 to which a coupling portion 233 of the opening and closing member 230 described later is inserted.

The opening and closing member 230 may include the coupling portion 233 formed above the seating portion 232. The coupling portion 233 may extend from the inside of the body 231 toward the rear side. The coupling portion 233 may pass through the connecting member 220 and be inserted into the connecting member 220. In this case, an inclined surface 234 may be formed on an upper surface of the coupling portion 233 to be easily inserted into the connecting member 220.

The coupling portion insertion hole 226 formed in the connecting member 220 may have a size corresponding to or smaller than a coupling cross section of the coupling portion 233 of the opening and closing member 230. Accordingly, because the connecting member 220 is fitted to the coupling portion 233 of the opening and closing member 230, the movement of the connecting member 220 may be transmitted to the opening and closing member 230.

The opening and closing member 230 may include a cold air inlet 235 provided under the seating portion 232. The cold air inlet 235 is formed as a hole penetrating the body 231 of the opening and closing member 230. The cold air inlet 235 is provided to allow cold air to pass through the cold air outlet 60 of the main body 10. The cold air inlet 235 may be formed on the left side of the opening and closing member 230 when viewed from the front. In other words, the cold air inlet 235 may be formed on the right side of the opening and closing member 230 when viewed from the rear. However, the position of the cold air inlet 235 is not limited thereto, and the principle of opening and closing the cold air outlet 60 by the opening and closing member 230 will be described later.

As for the cold air regulator 200, the knob 210 is a configuration that is exposed to a user, and thus according to the embodiment of the disclosure, the knob 210 and the connecting member 220 are formed as a separate configuration and then coupled to each other. Therefore, it is possible to change the color or shape of the knob 210 in accordance with the design during manufacturing.

However, it has been described that separate components, such as the knob 210, the connecting member 220, and the opening and closing member 230, are coupled and then form the cold air regulator according to the embodiment, but it is not limited to this arrangement, and the cold air regulator may be integrally formed by injection molding. Alternatively, the cold air regulator may be formed in such a way that the connecting member and the knob are integrally formed and the opening and closing member is separately coupled thereto, or the connecting member and the opening and closing member are integrally formed and then the knob is separately coupled thereto.

As mentioned above, because the knob 210 is seated on the upper portion of the connecting member 220 and the connecting portion 220 is fitted into the upper rear portion of the opening and closing member 230, the opening and closing member 230 may be placed at a height relatively less than the connecting portion 220.

As the cold air regulator 200 is seated to be slidable inside the first frame 120, the height of the bottom surface of the first frame 120, on which the connecting member 220 is seated, and the height of the bottom surface of the first frame 120, on which the opening and closing member 230 is seated, may be different from each other according to the above mentioned structure. Particularly, the height of the bottom surface of the first frame 120, on which the opening and closing member 230 is seated may be less than the height of the bottom surface of the first frame 120, on which the third connecting portion 227 of the connecting member 220 is seated. Accordingly, a second accommodation portion 125 (see FIG. 3) accommodating the opening and closing member 230 which will be described later, may be provided in an approximate shape protruding from the first frame 120.

The connecting member 220 may be formed of a material having a certain thickness and a certain weight and thus the connecting member 220 may reliably transmit a force which is applied to the knob 210, to the opening and closing member 230. Further, the connecting member 220 may be formed of a material such as poly oxy methylene (POM), nylon, poly ketone, etc., which are resistant to deformation and abrasion. Because the connecting member 220 is moved in close contact between the plurality of guide ribs 121 and the shelf frames 110 and 120, the connecting member 220 may be formed of a material having a shelf-lubricating component that is easy to move.

Figure 8:
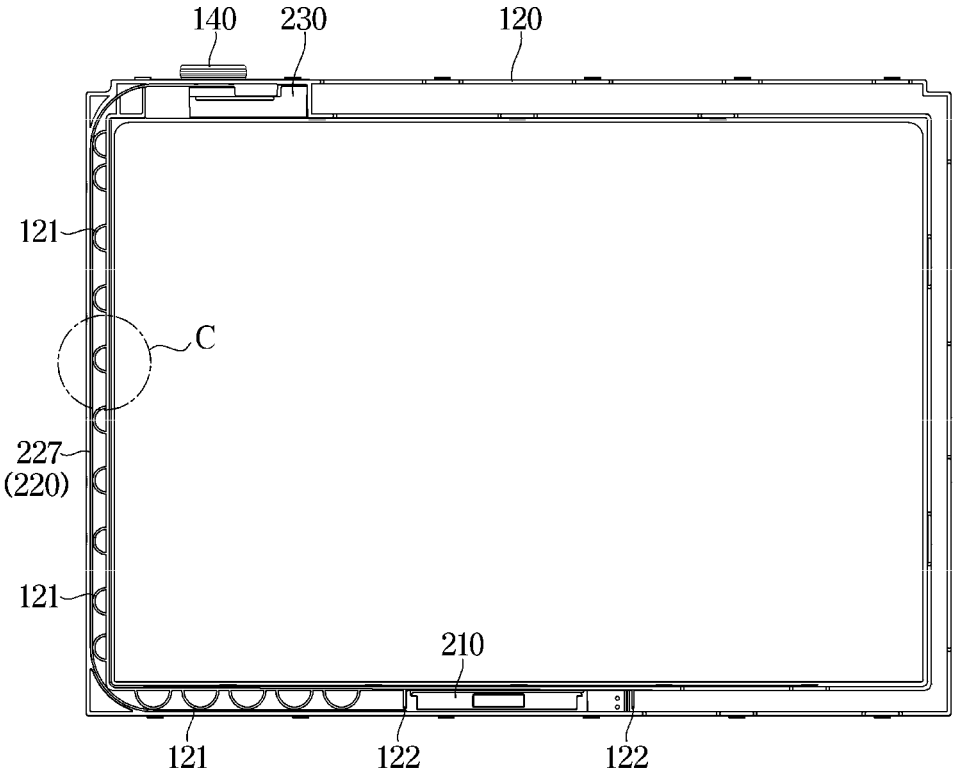
FIG. 8 is a top plan view illustrating a state in which the cold air regulator of the refrigerator is mounted to a first frame according to an embodiment of the disclosure.
Figure 9:
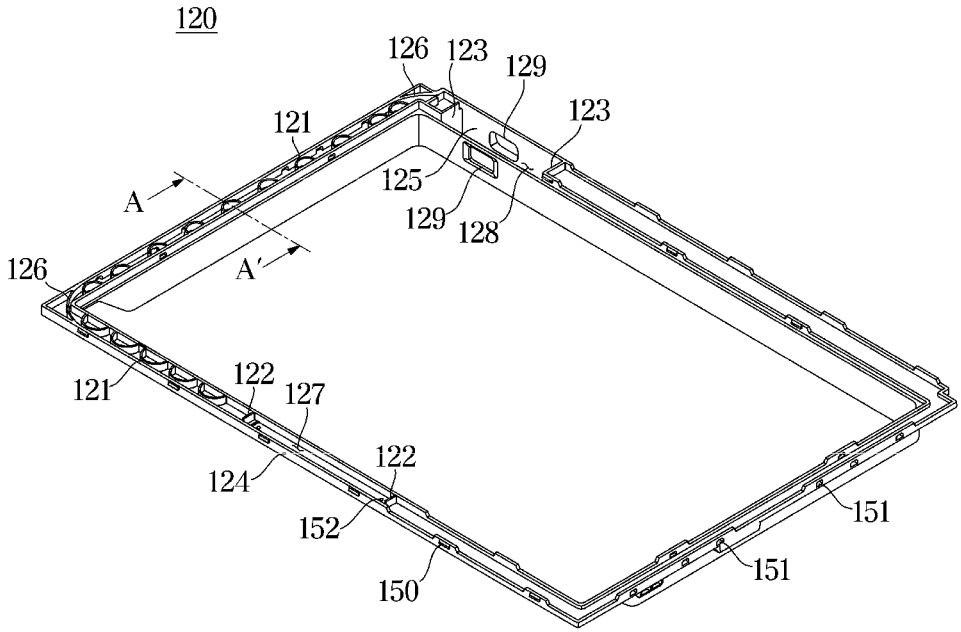
FIG. 9 is a perspective view illustrating the first frame of the refrigerator according to an embodiment of the disclosure.
Figure 10:
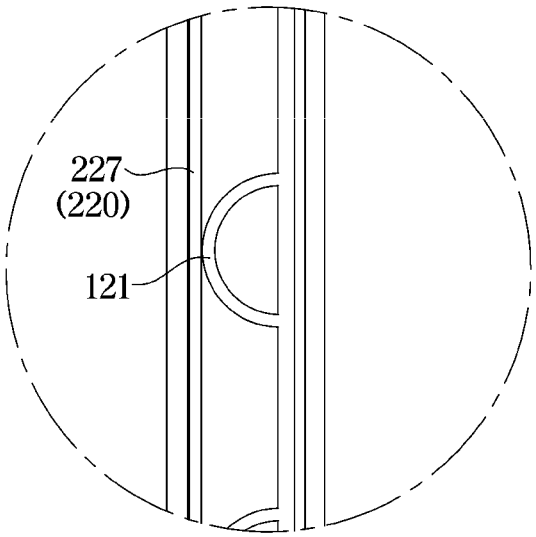
FIG. 10 is a view illustrating an enlarged portion C of FIG. 9.
Figure 11:
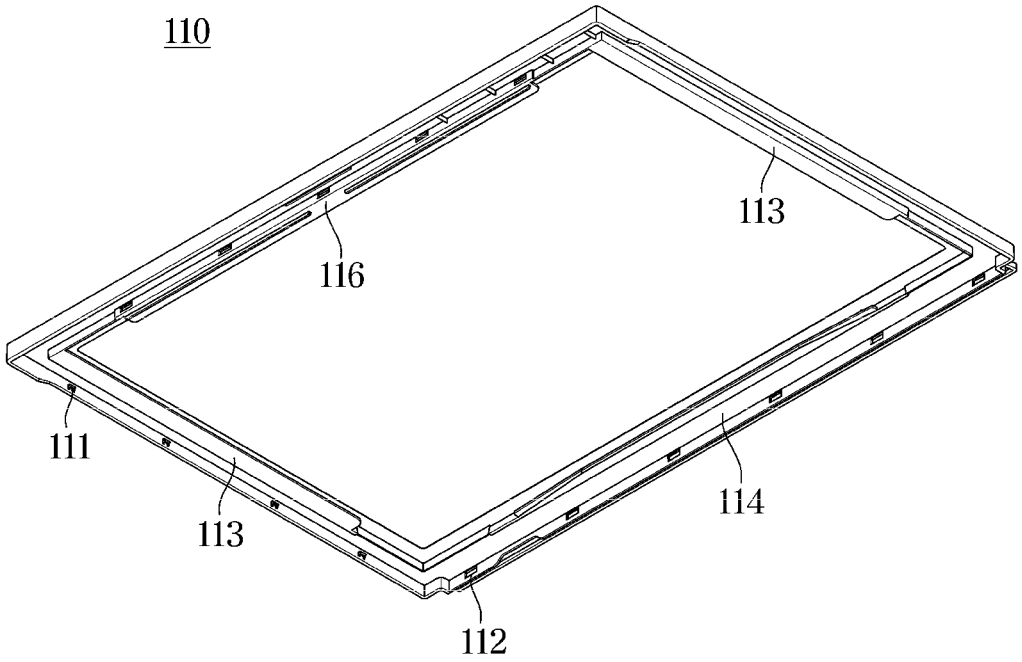
FIG. 11 is a bottom perspective view illustrating a second frame of the refrigerator according to an embodiment of the disclosure.
Figure 12:
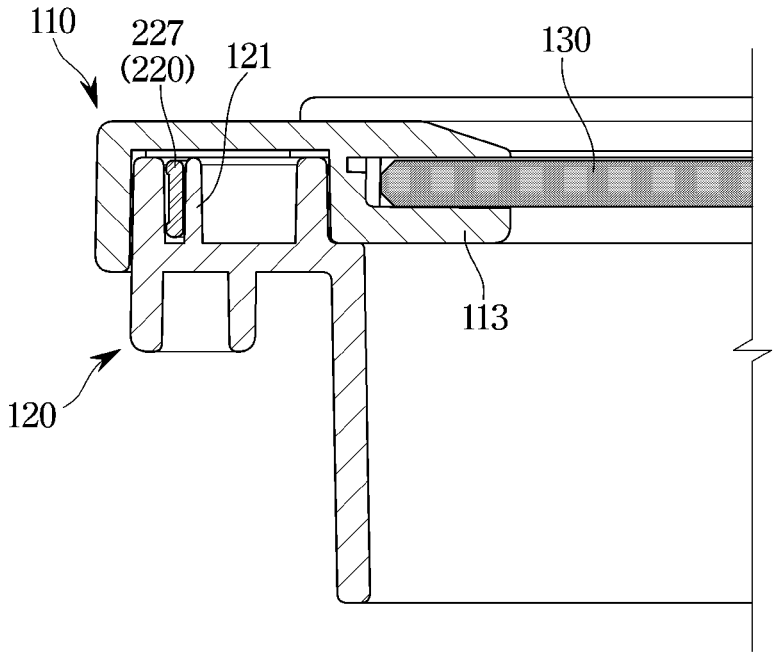
FIG. 12 is a sectional view illustrating the shelf shown in FIG. 2 taken along line A-A' of FIG. 9.

FIG. 8 is a top plan view illustrating a state in which the cold air regulator of the refrigerator is mounted to a first frame according to an embodiment of the disclosure. FIG. 9 is a perspective view illustrating the first frame of the refrigerator according to an embodiment of the disclosure. FIG. 10 is a view illustrating an enlarged portion C of FIG. 9. FIG. 11 is a bottom perspective view illustrating a second frame of the refrigerator according to an embodiment of the disclosure. FIG. 12 is a sectional view illustrating the shelf shown in FIG. 2 taken along line A-A' of FIG. 9.

Referring to FIGS. 8 and 9, the cold air regulator 200 may be accommodated movably within the first frame 120.

The first frame 120 may include a first accommodation portion 124 accommodating the knob 210 of the cold air regulator 200 and the second accommodation portion 125 accommodating the opening and closing member 230 of the cold air regulator 200.

The first frame 120 is provided with a pair of first partitions 122 to define the first accommodation portion 124. The pair of first partitions 122 is provided substantially perpendicular to an inner wall and an outer wall of the first frame 120. The pair of first partitions 122 extends upward from the bottom surface of the first frame 120. The pair of first partitions 122 is provided in the front central portion of the first frame 120.

However, when the arrangement of the knob 210 is changed as described above, the pair of first partitions 122 may also be formed at corresponding positions and thus the position of the first partition 122 is not limited thereto.

A space defined by the pair of first partitions 122 and inner and outer walls of the first frame 120 may be a first accommodation space 127 accommodating the knob 210. Therefore, the knob 210 of the cold air regulator 200 is provided to be movable inside the first accommodation space 127.

In addition, a drain hole 152 may be formed on the bottom surface of the first accommodation portion 124. When cleaning the shelf 100, water or foreign substances may be discharged through the drain hole 152.

In addition, a pair of second partitions 123 is provided in the first frame 120, thereby defining the second accommodation portion 125. The pair of second partitions 123 is provided substantially perpendicular to the inner wall and the outer wall of the first frame 120. The pair of second partitions 123 extends upward from the bottom surface of the first frame 120. The pair of second partitions 123 is provided on one side of the rear portion of the first frame 120.

However, when the position of the cold air outlet 60 is changed as described above and the arrangement of the opening and closing member 230 is changed, the pair of second partitions 123 may also be formed at corresponding positions and thus the position of the second partitions 123 is not limited thereto.

A space defined by the pair of second partitions 123 and inner and outer walls of the first frame 120 may be a second accommodation space 128 accommodating the opening and closing member 230. Therefore, the opening and closing member 230 is provided to be movable inside the second accommodation space 128.

The second accommodation portion 125 may include an opening 129 formed on the inner and outer walls of the first frame 120, respectively. The opening 129 forms a flow path to allow the cold air, which is discharged from the cold air outlet 60, to move to the lower portion of the shelf 100. The opening 129 may be provided in a shape corresponding to the cold air inlet 235 of the opening and closing member 230 described above.

However, the shape of the opening 129 formed in the second accommodation portion 125 may not be limited thereto. For example, the opening 129 may be formed larger than that shown in FIG. 9, and particularly, the opening 129 may be formed in such a way that most of the outer wall and the inner wall of the second accommodation portion 125 of the first frame 120 is cut off. Alternatively, the opening 129 of the outer wall may be provided in a hole shape, and the opening 129 of the inner wall may be provided in a form in which the inner wall is cut out by the moving distance of the opening and closing member 230, as shown in FIG. 9.

That is, because it is the opening and closing member 230 that opens and closes the cold air outlet 60, it is sufficient that the second accommodation portion 125 of the first frame 120 is formed to allow the cold air to be completely discharged in response to that the cold air inlet 235 of the opening and closing member 230 opens the cold air outlet 60.

Accordingly, as long as the second accommodation portion 125 of the first frame 120 includes a portion supporting the movement of the opening and closing member 230, there is no limitation in the cut range and the shape of the opening 129.

In addition, as will be described later, because the opening and closing member 230 is moved by a moving distance of the knob 210, it is appropriate that a length of the first accommodation space 127 of the first accommodation portion 124 is the same as a length of the second accommodation space 128 of the second accommodation portion 125 with respect to the moving direction of the cold air regulator 200, but the length thereof is not limited thereto.

The first frame 120 may include a curved portion 126. The curved portion 126 may extend upward from the bottom surface of the first frame 120 and formed in a curved shape at a corner side of the first frame 120. Therefore, as shown in FIG. 8, the connecting member 220 may be supported by the curved portion 126 and bent smoothly, and thus the connecting member 220 may be slidable inside the first frame 120.

Referring to FIGS. 8 to 10, the first frame 120 may include the plurality of guide ribs 121 provided to guide the sliding movement of the cold air regulator 200.

Particularly, the plurality of guide ribs 121 may be formed on the rim of the first frame 120 to assist the movement of the connecting member 220. The plurality of guide ribs 121 may be formed between the first accommodation portion 124 and the second accommodation portion 125.

The plurality of guide ribs 121 may extend upward from the bottom surface of the first frame 120. The extension is performed in a direction perpendicular to the moving direction of the connecting member 220 to be described later, and thus the plurality of guide ribs 121 may be provided to press one side of the connecting member 220. The plurality of guide ribs 121 may be formed to be spaced apart along the rim of the first frame 120. Particularly, the plurality of guide ribs 121 may be formed to be connected to the inner wall of the first frame 120.

The connecting member 220 may be inserted between the plurality of guide ribs 121 and the side wall of the first frame 120. Particularly, the connecting member 220 may be moved in close contact between the plurality of guide ribs 121 and the outer wall of the first frame 120.

Because the plurality of guide ribs 121 is formed to be spaced apart, a contact area between the plurality of guide ribs 121 and the connecting member 220 may be reduced in comparison with a case in which the plurality of guide ribs 121 is integrally formed. In addition, because the guide rib 121 formed in a curved shape comes into contact with the connecting member 220, the contact area between the connecting member 220 and the guide rib 121 may be minimized.

Accordingly, a frictional force between the connecting member 220 and the guide rib 121 is minimized and thus the connecting member 220 may be smoothly moved inside the first frame 120. In addition, by assisting the movement of the connecting member 220, which is according to the operation of the knob 210, through the configuration of the plurality of guide ribs 121, it is possible to prevent the connecting member 220 from being bent, thereby reliably transmitting the force acting on the knob 210 to the opening and closing member 230.

FIGS. 8 to 10 illustrate that the plurality of guide ribs 121 is formed in a substantially semicircular shape according to the embodiment, but is not limited thereto. Therefore, the plurality of guide ribs 121 may be formed in a linear shape. In a case in which the plurality of guide ribs 121 formed in a linear shape extends toward the connecting member 220 and the plurality of guide ribs 121 is spaced apart from each other along the longitudinal direction of the connecting member 220, an end of the plurality of guide ribs 121 may press the connecting member 220 so as to assist the movement of the connecting member 220. Even in this case, the frictional force between the connecting member 220 and the guide rib 121 is minimized, and thus the user convenience in the operation may be improved. In addition, the linear guide rib 121 may be formed in various shapes, such as a straight line or a curved line, as long as a shape is provided to press the connecting member 220 with a minimum contact area.

In addition, FIGS. 8 to 10 and 12 illustrate that the plurality of guide ribs 121 is connected to the inner wall of the first frame 120, but is not limited thereto. Alternatively, the plurality of guide ribs 121 may be connected to the outer wall of the first frame 120. At this time, the plurality of guide ribs 121 may be formed in a shape in which the semicircle shown in FIGS. 8 to 10 and 12 is rotated approximately 180 degrees and extend from the outer wall of the first frame 120 toward the inner wall. In this case, the connecting member 220 may be moved in close contact between the plurality of guide ribs 121 and the inner wall of the first frame 120.

Referring to FIGS. 9 and 11, the first frame 120 may include a plurality of protrusions 150 and a plurality of coupling holes 151. The second frame 110 may also include a plurality of holes 112 and a plurality of hooks 111 corresponding thereto.

The first frame 120 may include the plurality of protrusions 150 protruding forward from the front outer surface. In addition, the first frame 120 may include the coupling hole 151 formed on the outer surface of the right side. Although not shown in the drawing, the plurality of protrusions 150 protruding rearward from the rear outer surface of the first frame 120 may be formed on the first frame 120, and the plurality of coupling holes 151 may be formed on the outer surface of the left side of the first frame 120.

The plurality of protrusions 150 of the first frame 120 may be inserted into the plurality of holes 112 formed in the second frame 110. In addition, the plurality of hooks 111 of the second frame 110 may be inserted and coupled into the plurality of coupling holes 151 of the first frame 120. Therefore, the first frame 120 and the second frame 110 may maintain a coupling structure without a separate fastening member. However, for a more solid coupling, a fastening member (not shown) may be coupled.

In addition, referring to FIGS. 11 and 12, the second frame 110 may include a plurality of glass seating portions 113, 114, and 116.

The second frame 110 may include a first glass seating portion 116 formed at the front portion of the second frame 110 and provided to extend downward from the upper surface of the second frame 110 and bent substantially parallel to the upper surface. The second frame 110 may include a second glass seating portion 114 formed at the rear portion of the second frame 110 and provided to extend downward from the upper surface of the second frame 110 and bent substantially parallel to the upper surface. The second frame 110 may include a pair of third glass seating portions 113 formed on both lateral sides of the second frame 110 and provided to extend downward from the upper surface of the second frame 110 and bent substantially parallel to the upper surface.

Accordingly, as shown in FIG. 12, the glass 130 may be inserted between the upper surface of the second frame 110 and the plurality of glass seating portions 113, 114 and 116 and then the glass 130 may be mounted on the second frame 110. In addition, the second frame 110 may cover the upper portion of the connecting member 220 of the cold air regulator 200, which is accommodated between the outer wall of the first frame 120 and the guide rib 121, so as to prevent the connecting member 220 from being separated.

Figure 13:
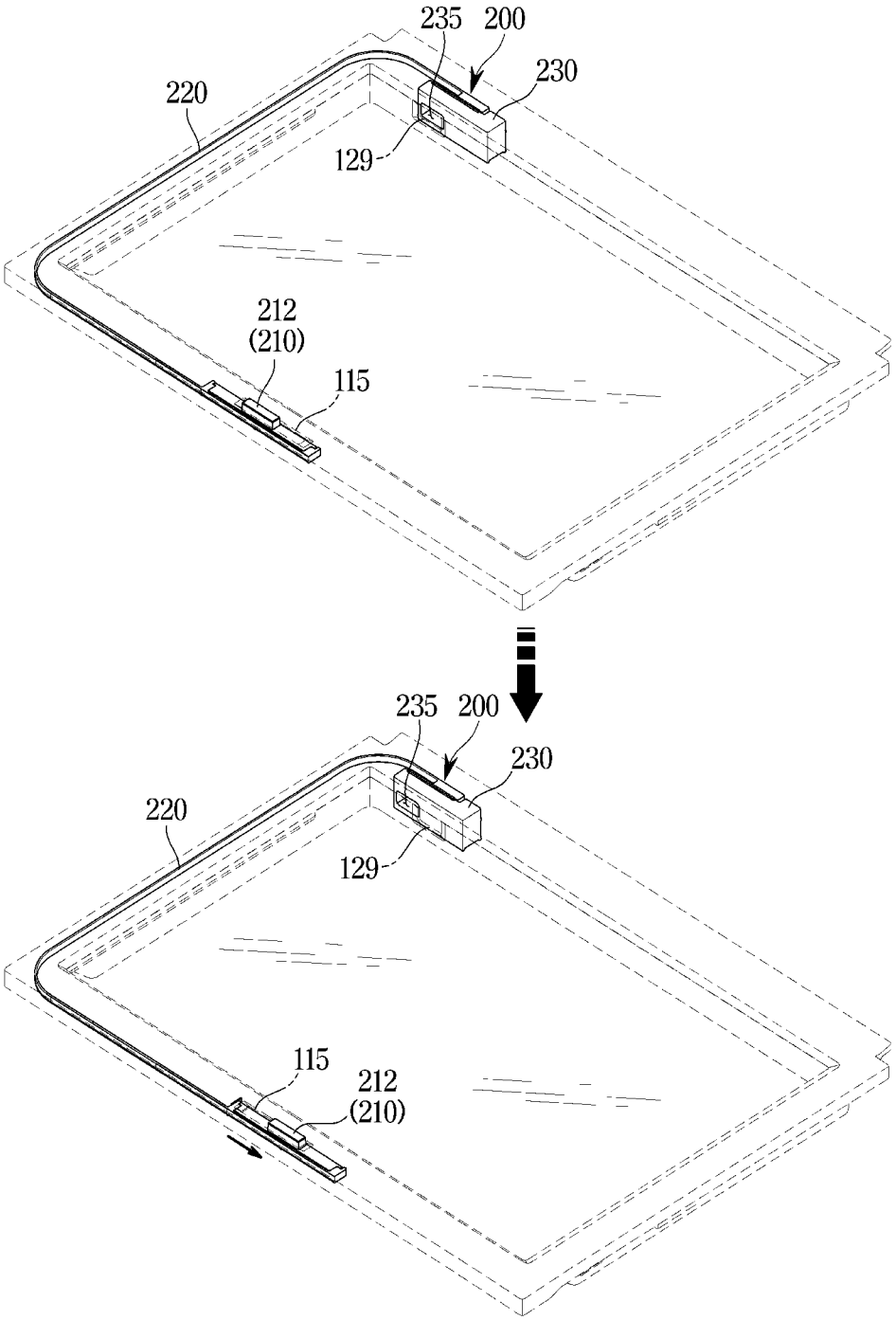
FIG. 13 is a perspective view illustrating an operation of the cold air regulator in the shelf of the refrigerator according to an embodiment of the disclosure.
Figure 14:
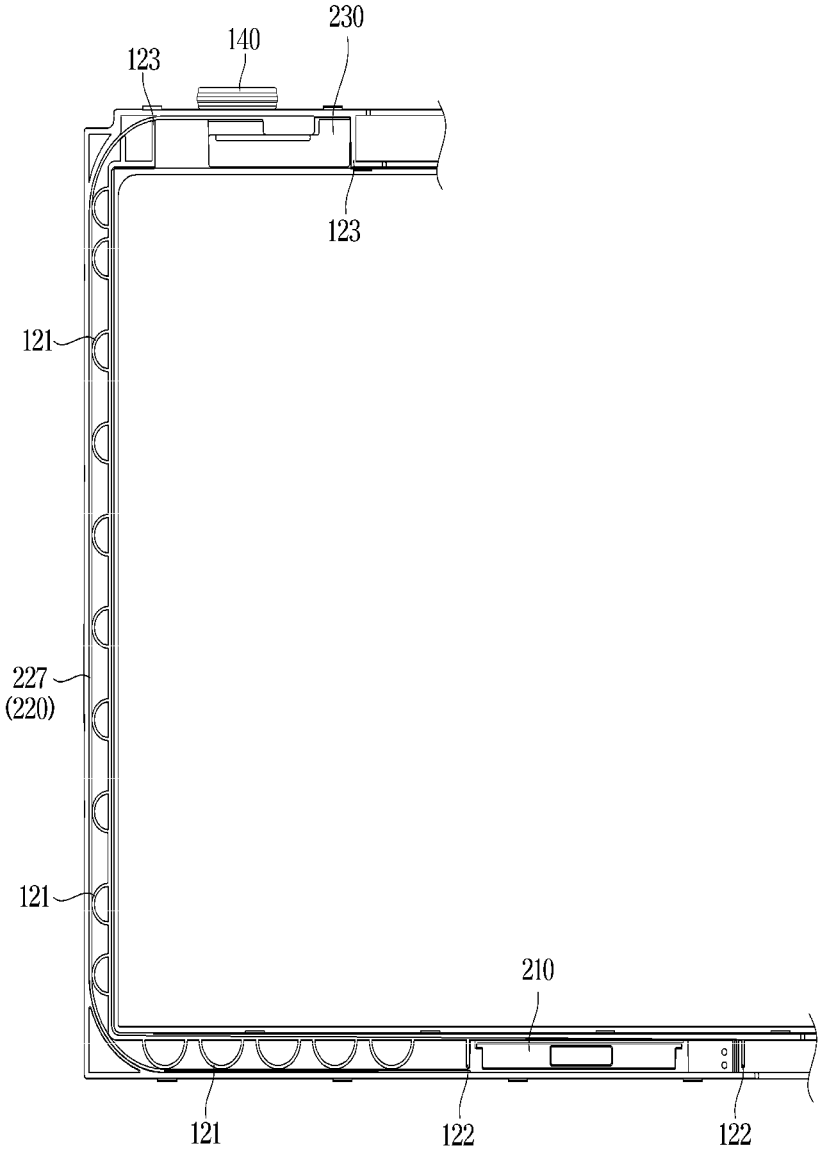
FIG. 14 is a top plan view illustrating a state in which the cold air regulator opens a cold air outlet on the shelf of the refrigerator according to an embodiment of the disclosure.
Figure 15:
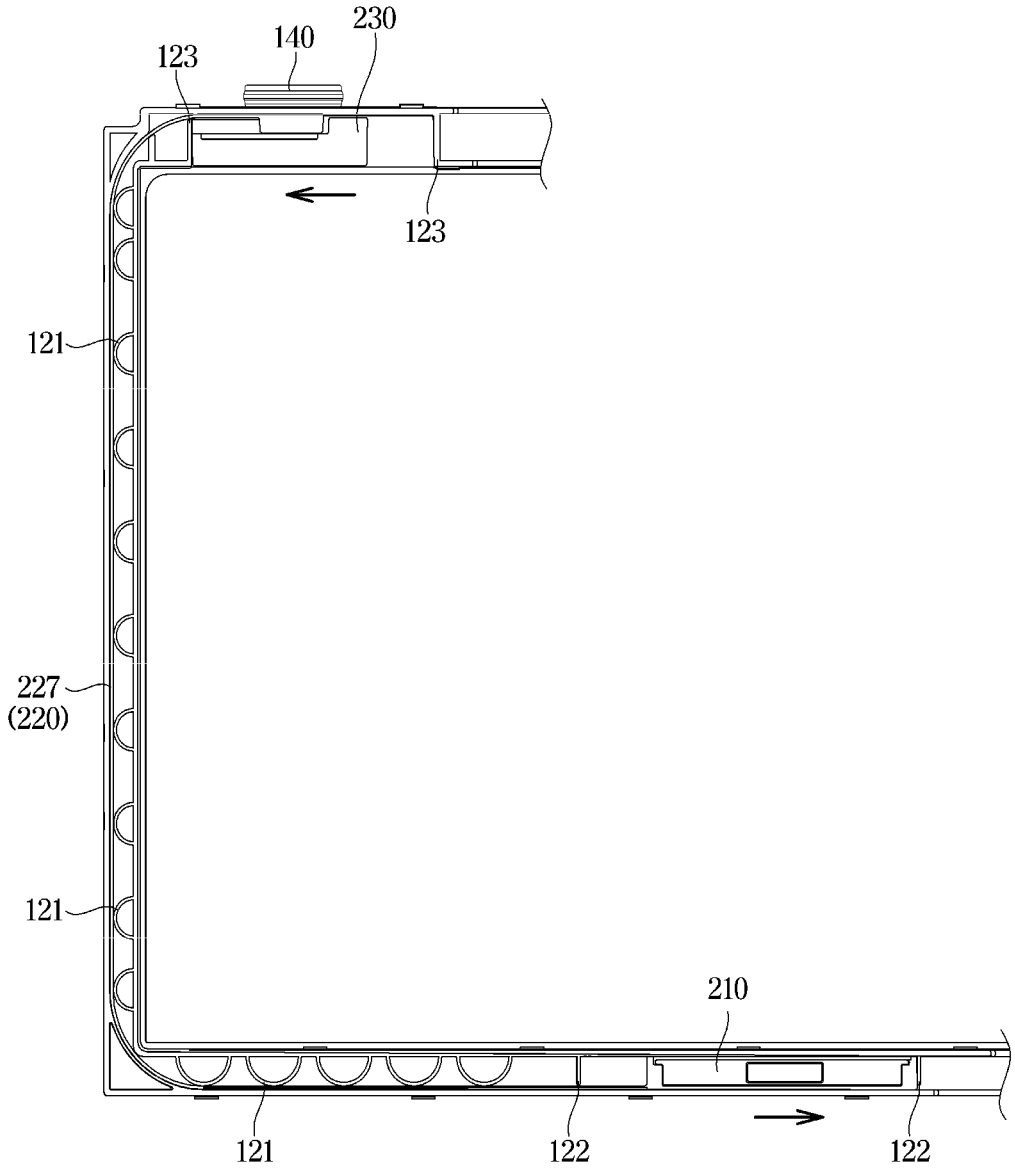
FIG. 15 is a top plan view illustrating a state in which the cold air regulator closes the cold air outlet on the shelf of the refrigerator according to an embodiment of the disclosure.

FIG. 13 is a perspective view illustrating an operation of the cold air regulator in the shelf of the refrigerator according to an embodiment of the disclosure. FIG. 14 is a top plan view illustrating a state in which the cold air regulator opens a cold air outlet on the shelf of the refrigerator according to an embodiment of the disclosure. FIG. 15 is a top plan view illustrating a state in which the cold air regulator closes the cold air outlet on the shelf of the refrigerator according to an embodiment of the disclosure.

An opening and closing operation of the cold air outlet 60 according to the movement of the cold air regulator 200 will be described with reference to FIGS. 13 to 15.

The connecting member 220 of the cold air regulator 200 is accommodated in the inside of the shelf 100 along the rim of the shelf 100. The knob 210 is connected to one end of the connecting member 220 and the opening and closing member 230 is connected to the other end of the connecting member 220. The cold air regulator 200 is provided to slide with respect to the shelf frames 110 and 120.

As illustrated in an upper drawing of FIG. 13 and a drawing of FIG. 14, when the knob 210 is moved to the left side with respect to the knob through hole 115 of the second frame 110, the cold air inlet 235 of the opening and closing member 230, which is connected to the knob 210 through the connecting member 220, may be in communication with the cold air outlet 60 of the main body 10. In addition, the opening 129 of the first frame 120 accommodating the opening and closing member 230 is also in communication with the cold air inlet 235. Accordingly, the cold air discharged through the cold air outlet 60 may pass through the opening 129 of the first frame 120 and the cold air inlet 235 of the opening and closing member 230. That is, the cold air outlet 60 is in an open state, and the cold air may be supplied to the lower side of the shelf 100.

As illustrated in a lower drawing of FIG. 13 and a drawing of FIG. 15, when the knob 210 is moved to the right side with respect to the knob through hole 115 of the second frame 110 by the user's manipulation, the connecting member 220 slides with respect to the shelf frames 110 and 120 according to the movement of the knob 210. At the same time, the opening and closing member 230 connected to the connecting member 220 is also moved in the direction in which the connecting member 220 pulls the opening and closing member 230. As illustrated in FIGS. 13 and 15, as the knob 210 is moved to the right side, the opening and closing member 230 is moved to the left side.

Accordingly, the cold air outlet 60 of the main body 10 and the cold air inlet 235 of the opening and closing member 230 are no longer in communication. At this time, because the first frame 120 is also fixed in the storage compartment 20, the cold air inlet 235 and the opening 129 are no longer in communication by the movement of the opening and closing member 230.

In the above description, the open and closed state of the cold air outlet 60 according to the movement of the knob 210 may be changed. For example, when the knob 210 is moved to the right side with respect to the knob through hole 115, which is opposite to those shown in FIGS. 13 to 15, the cold air outlet 60 may be in the open state. In this case, when viewed from the front, the cold air inlet 235 of the opening and closing member 230 may be formed on the right side of the opening and closing member 230, which is opposite to that shown in FIG. 13.

Particularly, when the knob 210 is moved to the right side with respect to the knob through hole 115 of the second frame 110, the cold air inlet 235 of the opening and closing member 230 connected to the knob 210 by the connecting member 220 is in communication with the cold air outlet 60 of the main body 10.

In addition, the opening 129 formed in the inner and outer walls of the first frame 120 accommodating the opening and closing member 230 are also in communication with the cold air inlet 235 and the cold air outlet 60. Accordingly, the cold air discharged through the cold air outlet 60 may pass through the opening 129 of the first frame 120 and the cold air inlet 235 of the opening and closing member 230. That is, the cold air outlet 60 is in the open state, and accordingly, the cold air may be supplied to the lower side of the shelf 100.

When the knob 210 is moved to the left side with respect to the knob through hole 115 of the second frame 110 by the user's manipulation, the connecting member 220 slides with respect to the shelf frames 110 and 120 according to the movement of the knob 210. At the same time, the opening and closing member 230 connected to the connecting member 220 is also moved in the direction in which the connecting member 220 pushes the opening and closing member 230. As the knob 210 is moved to the left side, the opening and closing member 230 is moved to the right side, which is opposite to those shown in FIGS. 13 and 15.

Accordingly, the cold air outlet 60 of the main body 10 and the cold air inlet 235 of the opening and closing member 230 are no longer in communication. At this time, because the first frame 120 is also fixed to the storage compartment 20, the cold air inlet 235 and the opening 129 are no longer in communication by the movement of the opening and closing member 230.

As for the cold air regulator 200, the opening and closing member 230 is moved by the moving distance of the knob 210 by the connecting member 220. That is, the opening degree of the cold air outlet 60 may be adjusted by the degree of movement of the knob 210.

According to the embodiment of the disclosure, a user arbitrarily adjusts the degree of movement of the knob 210, but is not limited thereto. Alternatively, a stopper structure configured to allow an amount of movement of the knob 210 to be manipulated step by step may be formed on the shelf frames 110 and 120 or the knob 210 or both the shelf frames 110 and 120 and the knob 210.

The stopper is provided in a shape of a protrusion so as to interfere when a user moves the knob 210 according to each step. However, the disclosure is not limited thereto, and the knob 210 and the shelf frames 110 and 120 may be formed in a serrated structure in which the knob 210 and the shelf frames 110 and 120 are engaged with each other. However, the shape of the stopper may vary as long as the shape includes a structure interfering with the movement of the knob 210 step by step.

That is, the opening 129 formed in the first frame 120 is always in communication with the cold air outlet 60 of the main body 10. Accordingly, as a user manipulates the cold air regulator 200, the opening and closing member 230 may be moved to adjust the opening degree of the cold air outlet 60 and the opening 129 communicating therewith.

As mentioned above, the usability is improved because a user can adjust the opening degree of the cold air outlet 60 from the front side of the shelf 100.

In addition, because the cold air regulator 200 is moved along the rim of the shelf 100, the central portion of the shelf 100 may have a neat appearance, thereby increasing the aesthetics of the refrigerator 1.

Further, as the glass 130 is coupled to the central portion of the shelf 100 and the cold air regulator is moved to the outside of the rim of the glass 130, the view of the lower portion of the glass is not obstructed, and thus a user can easily identify objects stored in the lower portion of the shelf 100.

Figure 16:
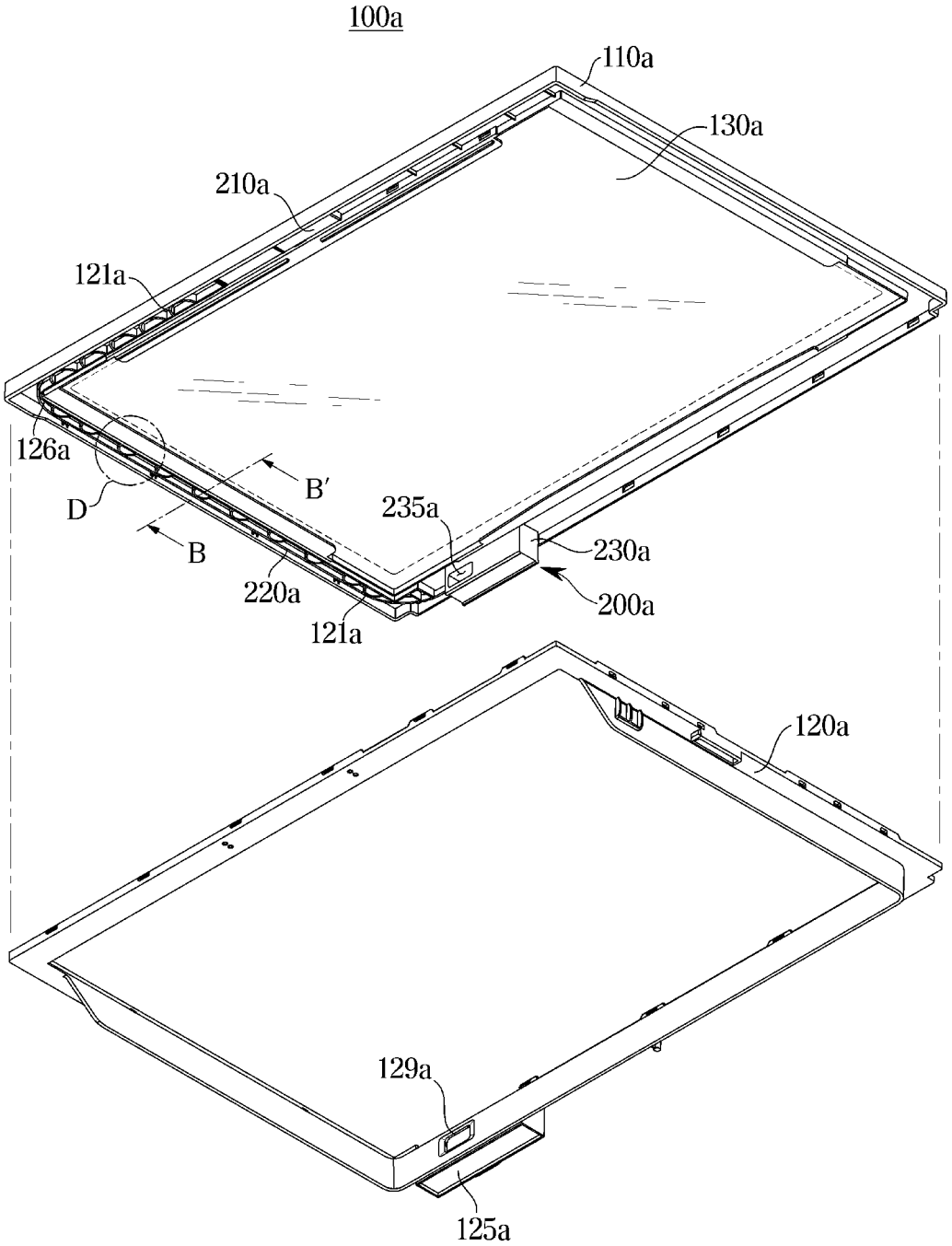
FIG. 16 is a bottom perspective view illustrating a state in which a portion of a shelf of a refrigerator according to another embodiment of the disclosure is exploded.
Figure 17:
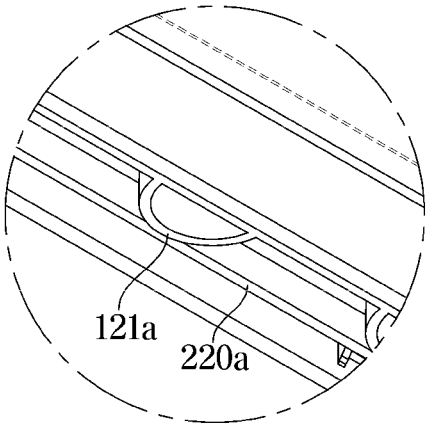
FIG. 17 is a front view illustrating an enlarged portion D of FIG. 16.
Figure 18:
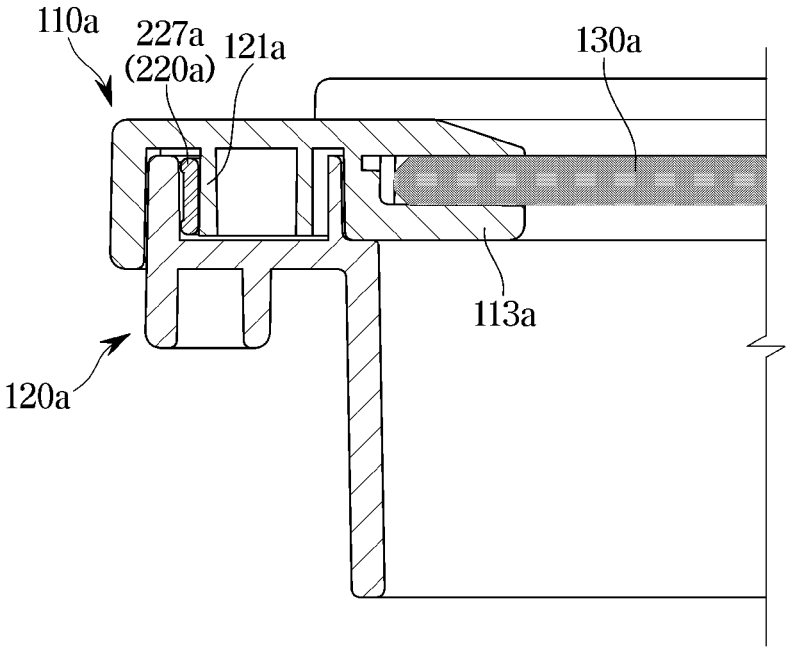
FIG. 18 is a sectional view illustrating the shelf taken along line B-B' of FIG. 16.

FIG. 16 is a bottom perspective view illustrating a state in which a portion of a shelf of a refrigerator according to another embodiment of the disclosure is exploded. FIG. 17 is a front view illustrating an enlarged portion D of FIG. 16. FIG. 18 is a sectional view illustrating the shelf taken along line B-B' of FIG. 16.

Referring to FIGS. 16 to 18, according to another embodiment of the disclosure, a shelf 100*a* may include a first frame 120*a*, a second frame 110*a*, a cold air regulator 200*a* and a glass 130*a*.

Hereinafter differences from the shelf 100 according to an embodiment of the disclosure will be mainly described, and other configurations may be described using the same reference numerals as the shelf 100 according to an embodiment of the disclosure.

The first frame 120*a* may be provided in a lower portion of the shelf and the second frame 110*a* may be provided in an upper portion of the shelf and coupled to an upper portion of the first frame 120*a*. The coupling method of the first frame 120*a* and the second frame 110*a* is the same as that of the shelf 100 according to an embodiment of the disclosure.

Unlike the shelf 100 according to an embodiment of the disclosure, in the shelf 100*a* according to another embodiment of the disclosure, the second frame 110*a* may include a plurality of guide ribs 121*a*.

The second frame 110*a* may include a curved portion 126*a*. The curved portion 126*a* may extend downward from an inside of an upper surface of the second frame 110*a* and be formed in a curved shape at a corner side of the second frame 110*a*. Accordingly, the connecting member 220*a* is supported by the curved portion 126*a* formed in the second frame 110*a* and bent smoothly to be movable inside the first frame 120*a*.

The second frame 110*a* may include the plurality of guide ribs 121*a* provided to guide a sliding movement of the cold air regulator 200*a*.

Particularly, the plurality of guide ribs 121*a* may be formed on the rim of the second frame 110*a* to assist the movement of the connecting member 220*a*.

The plurality of guide ribs 121*a* may extend downward from the inside of the upper surface of the second frame 110*a*. The plurality of guide ribs 121*a* may extend in a direction perpendicular to the moving direction of the connecting member, and be provided to press one side of the connecting member 220.

The plurality of guide ribs 121*a* may be formed to be spaced apart along the rim of the second frame 110*a*. Particularly, the plurality of guide ribs 121*a* may be formed to be connected to an inner wall of the second frame 110*a*.

The connecting member may be inserted between the plurality of guide ribs 121*a* and the side wall of the first frame 120*a*. Particularly, the connecting member may be moved in close contact between the plurality of guide ribs 121*a* and an outer wall of the first frame 120*a*.

Other than the fact that the plurality of guide ribs 121*a* is formed on the second frame 110*a* provided on the upper portion and thus the connecting member 220*a* of the cold air regulator 200*a* is accommodated and moved in the second frame 110*a*, the rest of the configuration may be provided in the same manner as the shelf 100 according to an embodiment of the disclosure.

Therefore, the knob 210*a* and the opening and closing member 230*a* of the cold air regulator 200*a* may be accommodated and movable inside the first frame 120*a* in the same manner as in the shelf 100 according to an embodiment of the disclosure. Particularly, the opening and closing member 230*a* may be accommodated in a second accommodation portion 125*a* of the first frame 120*a* and movable so as to communicate with or not to communicate with the opening 129*a*.

In addition, in the same manner as an embodiment of the disclosure, the plurality of guide ribs 121*a* may be formed in a linear shape. Alternatively, the semicircular shape of FIG. 16 may be rotated approximately 180 degrees, which is opposite to that shown in FIG. 16, and thus provided as a semicircle extending from the outer wall of the first frame 120*a* toward the inner wall. That is, the plurality of guide ribs 121*a* may be formed to be connected to the outer wall of the second frame 110*a*.

Figure 19:
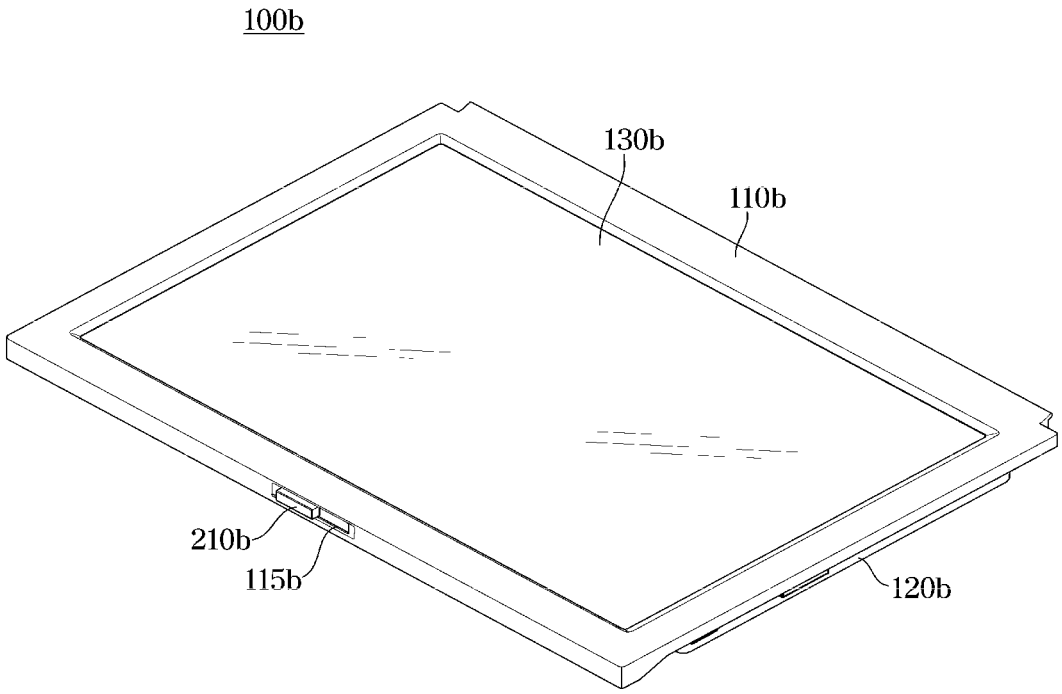
FIG. 19 is a perspective view illustrating a shaft of a refrigerator according to still another embodiment of the disclosure.
Figure 20:
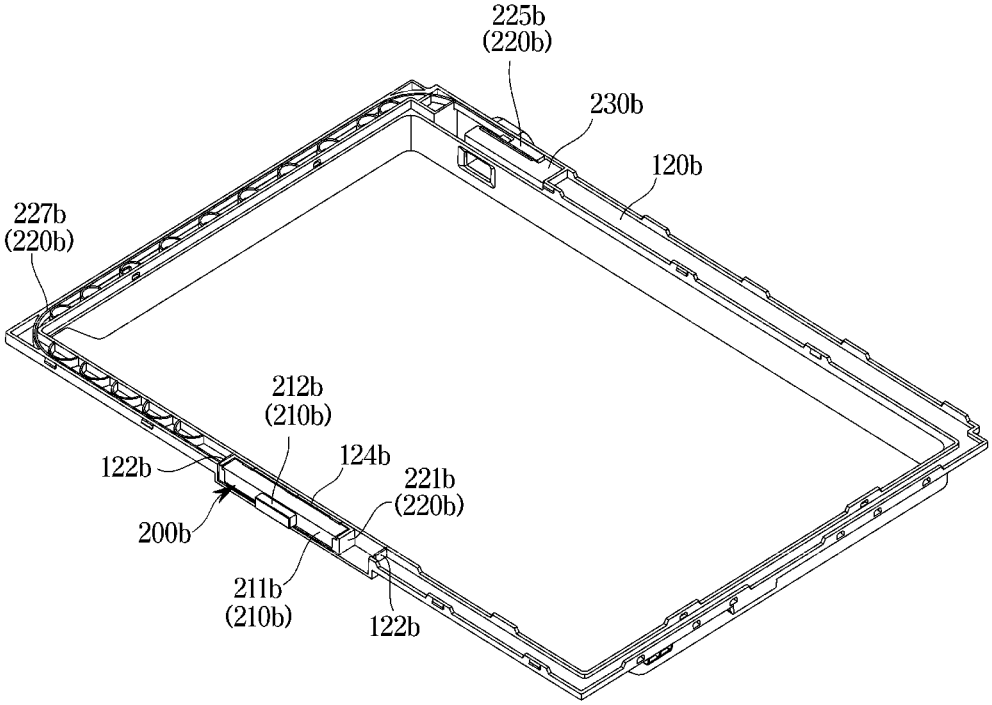
FIG. 20 is a perspective illustrating a state in which a cold air regulator of the refrigerator is mounted to a first frame according to still another embodiment of the disclosure.

FIG. 19 is a perspective view illustrating a shelf of a refrigerator according to still another embodiment of the disclosure. FIG. 20 is a perspective illustrating a state in which a cold air regulator of the refrigerator is mounted to a first frame according to still another embodiment of the disclosure.

Referring to FIGS. 19 and 20, according to still another embodiment of the disclosure, a shelf 100*b* may include a first frame 120*b*, a second frame 110*b* coupled to an upper portion of the first frame 120*b*, a cold air regulator 200*b* and a glass 130*b* mounted to the second frame 110*b*.

Unlike the shelf 100 according to an embodiment of the disclosure, in the shelf 100*b* according to still another embodiment of the disclosure, a grip portion 212*b* of a knob 210*b* may protrude toward the front of the shelf 100*b*.

Particularly, the cold air regulator 200*b* is configured to be slidable with respect to the first frame 120*b*. The cold air regulator 200*b* may include the knob 210*b* configured be manipulated by a user, an opening and closing member 230*b* configured to open and close the cold air outlet 60, and a connecting member 220*b* configured to transmit a force by connecting the knob 210*b* to the opening and closing member 230*b*.

The knob 210*b* may include a knob body 211*b* and a grip portion 212*b*. The grip portion 212*b* of the knob may be formed to extend forward from a front surface of the knob body 211*b*.

The first frame 120*b* may include a first accommodating portion 124*b* accommodating the knob 210*b*. Unlike the shelf 100 according to an embodiment of the disclosure, the knob 210*b* according to the embodiment is required to be gripped from the front of the shelf 100*b*. Therefore, the first accommodation portion 124*b* of the first frame 120*b* may be partitioned by a pair of first partitions 122*b* and formed in an approximately box in which an upper surface and a front surface are open.

In addition, a first connecting portion 221*b* of the connecting member 220*b* coupled to the knob 210*b* may also be provided in a shape in which a front surface is open.

Further, a knob through hole 115*b* of the second frame 110*b* may be formed in a front central portion of the second frame 110*b*. The grip portion 212*b* of the knob 210*b* may protrude forward and outward of the shelf 100*b* through the knob through hole 115*b*.

Accordingly, a user can manipulate the knob 210*b* from the front surface of the shelf 100*b*, thereby moving the cold air regulator 200*b*.

In addition, in the same manner as the shelf 100*a* according to another embodiment of the disclosure, the shelf 100*b* according to the embodiment may also be changed and implemented in such a way that the plurality of guide ribs 121 is formed on the upper second frame 110*b*.

Figure 21:
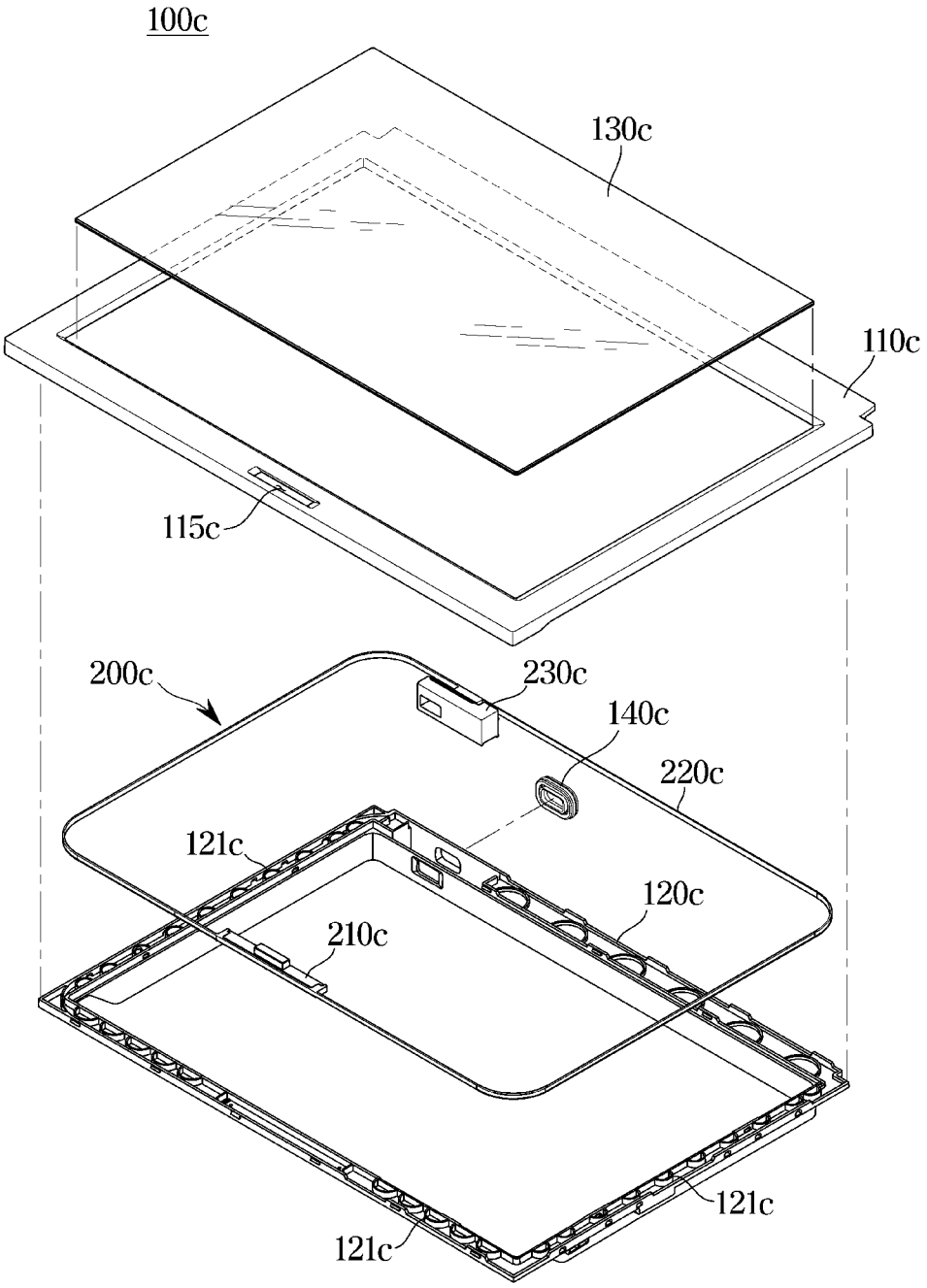
FIG. 21 is an exploded perspective view of a shelf of a refrigerator according to still another embodiment of the disclosure.

FIG. 21 is an exploded perspective view of a shelf of a refrigerator according to still another embodiment of the disclosure.

Referring to FIG. 21, in a shelf 100*c* according to still another embodiment of the disclosure, a cold air regulator 200*c* may be formed in a ring shape and accommodated over an entire rim of shelf frame 110*c* and 120*c*, which is different from the shelf 100, 100*a*, and 100*b* according to embodiments of the disclosure.

The shelf 100*c* according to still another embodiment of the disclosure may include a first frame 120*c* provided in a lower portion of the shelf, a second frame 110*c* coupled to an upper portion of the first frame 120*c*, a cold air regulator 200*c* configured to be movable between the first frame 120*c* and the second frame 110*c*, and a glass 130*c*. The shelf 100*c* may include a packing member 140*c* configured to block between the cold air outlet 60 and an opening of the first frame 120*c*.

The cold air regulator 200*c* may include a knob 210*c* provided to be manipulated from the outside, an opening and closing member 230*c* configured to open and close the cold air outlet 60, and a connecting member 220*c* provided to connect the knob 210*c* to the opening and closing member 230*c*.

According to the embodiment, the connecting member 220*c* may be formed in a closed ring shape along the rim of the first frame 120*c* and accommodated therein.

Further, the first frame 120*c* may include a plurality of guide ribs 121*c*. The plurality of guide ribs 121*c* may be formed on the left, right, front, and rear edges of the first frame 120*c* to guide the movement of the connecting member 220*c* provided in a closed ring shape.

As for the cold air regulator 200*c* according to the embodiment, the force acting on the knob 210*c* may be more reliably transmitted to the opening and closing member 230*c*.

In addition, in the shelf 100*c* according to the embodiment, the plurality of guide ribs 121*c* is formed on the upper second frame 110*c*, which is the same as the shelf 100*a* according to another embodiment of the disclosure, or the grip portion 212 of the knob 210*c* may be changed to protrude to the front surface of the knob body 211, which is the same as the shelf 100*b* according to still another embodiment of the disclosure.

As is apparent from the above description, because the opening degree of the cold air outlet is adjusted from the front side of the shelf, a user can easily adjust the temperature of the storage compartment, thereby improving the convenience of use.

Because the cold air regulator is moved along the rim of the shelf, the visibility of the lower side of the shelf is secured, and thus it is easy to check out objects stored therein.

The overall aesthetics of the shelf may be improved because the operating structure of the cold air regulator is not exposed to a user.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a storage compartment having an air outlet and configured to receive air through the air outlet; and a shelf coupled to the storage compartment, the shelf comprising:

a shelf frame which forms a rim of the shelf, the shelf frame having an opening facing the air outlet to be aligned with the air outlet; and an air regulator configured to be manipulated on the shelf frame to adjust an amount of air discharged from the air outlet to the storage compartment and including a connecting member configured to be slidable along the rim of the shelf, the air regulator configured to have a first position in which the air from the air outlet is blocked from passing through the opening in the shelf frame, and a second position in which the air from the air outlet is allowed to pass through the opening in the shelf frame, the shelf frame including an accommodation portion including the opening aligned with the air outlet, the accommodation portion configured to allow an opening and closing member to be movably accommodated in the accommodation portion, wherein the shelf frame comprises a plurality of guide ribs to guide a movement of the connecting member.

2. The refrigerator of claim 1, wherein the air discharged from the air outlet is cold air and the air regulator is a cold air regulator which comprises:

a knob coupled to the connecting member configured to be slidable along the rim of the shelf, the knob configured to protrude outside of the shelf frame so as to be manipulated; and the opening and closing member coupled to the connecting member and configured to open and close the air outlet based on movement between the first and second positions.

3. The refrigerator of claim 2, wherein the knob is configured to be movable with respect to the shelf frame, and the connecting member and the opening and closing member are moved by a distance corresponding to a distance by which the knob is moved.

4. The refrigerator of claim 2, wherein the opening and closing member comprises a coupling portion extending toward the connecting member to be coupled to the connecting member, and the connecting member includes an insertion hole into which the coupling portion is configured to be inserted.

5. The refrigerator of claim 2, wherein the shelf frame comprises the accommodation portion on a side of the shelf frame.

6. The refrigerator of claim 2, wherein the connecting member is formed of a poly oxy methylene (POM).

7. The refrigerator of claim 2, wherein the opening and closing member comprises a body having an air inlet configured to communicate with the air outlet so as to pass the cold air based on the air regulator being in the second position.

8. The refrigerator of claim 1, wherein the connecting member is movable between the plurality of guide ribs and a side wall of the shelf frame.

9. The refrigerator of claim 1, wherein each of the plurality of guide ribs has a curved shape and is configured to be in contact with the connecting member.

10. The refrigerator of claim 1, wherein each of the plurality of guide ribs extends from one surface of the shelf frame in a direction perpendicular to a moving direction of the connecting member.

11. The refrigerator of claim 1, wherein the opening and closing member comprises a body having an air inlet configured to communicate with the air outlet so as to pass cold air.

12. The refrigerator of claim 11, wherein the opening in the shelf frame comprises openings respectively formed in an inner wall and an outer wall of the shelf frame so as to correspond to the air inlet of the opening and closing member, and cold air discharged from the air outlet is supplied to the storage compartment through the openings in the shelf frame and the air inlet of the opening and closing member.

13. The refrigerator of claim 12, further comprising:

a packing member mounted on the shelf frame to extend between the opening formed in the outer wall of the shelf frame and the air outlet.

14. The refrigerator of claim 1, wherein the shelf further comprises a glass coupled to the shelf frame to support an object, and the air regulator is coupled to an outside of a rim of the glass and configured to be movable with respect to the shelf frame.

15. The refrigerator of claim 1, wherein the shelf frame comprises:

a first frame which is a lower portion of the shelf frame; and a second frame coupled to an upper portion of the first frame, the air regulator is accommodated in a space between the first frame and the second frame, and is configured to be movable with respect to the shelf frame.

16. A refrigerator comprising:

a storage compartment having an air outlet and configured to receive air through the air outlet; and a shelf coupled to the storage compartment, the shelf comprising:

a shelf frame which forms a rim of the shelf and which includes an opening facing the air outlet to be aligned with the air outlet in the storage compartment; and an air regulator comprising a knob movably coupled to the shelf, the air regulator being configured to have a first position in which the air from the air outlet is blocked from passing through the opening in the shelf frame, and a second position in which the air from the air outlet is allowed to pass through the opening in the shelf frame, the knob configured to be movable to open and close the air outlet by sliding with respect to the shelf frame based on a movement of the knob, the shelf frame including an accommodation portion including the opening aligned with the air outlet, the accommodation portion configured to allow an opening and closing member to be movably accommodated in the accommodation portion, wherein the opening and closing member is coupled to a connecting member and comprises a body having an air inlet configured to communicate with the air outlet so as to pass cold air.

17. The refrigerator of claim 16, wherein the air regulator comprises the opening and closing member on the side of the shelf frame including the opening, to open and close the air outlet; and a connecting member coupled to the knob and the opening and closing member, and the connecting member and the opening and closing member are configured to be moved based on a moving distance of the knob.

18. The refrigerator of claim 17, wherein the shelf frame comprises a plurality of guide ribs extending from one side wall of the shelf frame to allow the connecting member to be moved along the one side wall of the shelf frame.

19. A refrigerator comprising:

a storage compartment having an air outlet and configured to receive air through the air outlet;

a shelf frame coupled to the storage compartment, the shelf frame having an opening facing the air outlet to be aligned with the air outlet;

a glass having a rim coupled to the shelf frame; and an air regulator coupled to be slidable inside the shelf frame to adjust an amount of air discharged from the air outlet, the air regulator provided outside the rim of the glass and configured to have a first position in which the air from the air outlet is blocked from passing through the opening in the shelf frame, and a second position in which the air from the air outlet is allowed to pass through the opening in the shelf frame, the shelf frame including an accommodation portion including the opening aligned with the air outlet, the accommodation portion configured to allow an opening and closing member to be movably accommodated in the accommodation portion, wherein the shelf frame, the air regulator and the glass form a shelf, the shelf frame defines a perimeter of the shelf, and the air regulator is configured to be slidable inside the shelf frame along the perimeter of the shelf.

20. The refrigerator of claim 19, wherein the shelf frame comprises a plurality of guide ribs formed in a curved shape to guide a movement of the air regulator.

21. The refrigerator of claim 19, wherein the shelf includes a front edge, a rear edge and two side edges, and the air regulator extends along at least portions of the front edge, the rear edge and one of the two side edges of the shelf.

* * * * *